US008701307B2

(12) United States Patent
Slack et al.

(10) Patent No.: US 8,701,307 B2
(45) Date of Patent: Apr. 22, 2014

(54) METHOD FOR CLEANING AND RECONDITIONING FCR APG-68 TACTICAL RADAR UNITS

(71) Applicants: Howard C. Slack, Columbia, MD (US); Clare L Milton, Baltimore, MD (US); Andrew F. Slack, Columbia, MD (US)

(72) Inventors: Howard C. Slack, Columbia, MD (US); Clare L Milton, Baltimore, MD (US); Andrew F. Slack, Columbia, MD (US)

( * ) Notice: Subject to any disclaimer, the term of this patent is extended or adjusted under 35 U.S.C. 154(b) by 0 days.

(21) Appl. No.: 13/694,399

(22) Filed: Nov. 29, 2012

(65) Prior Publication Data

US 2013/0118709 A1 May 16, 2013

Related U.S. Application Data

(63) Continuation-in-part of application No. 13/373,385, filed on Nov. 14, 2011, now Pat. No. 8,505,212, and a continuation of application No. 12/256,447, filed on Oct. 22, 2008, now Pat. No. 8,082,681, and a continuation of application No. 12/212,623, filed on Sep. 17, 2008, now Pat. No. 8,056,256.

(51) Int. Cl.
*F26B 5/04* (2006.01)

(52) U.S. Cl.
USPC ..... 34/381; 34/412; 165/95; 414/805; 62/126; 29/602.1

(58) Field of Classification Search
USPC ..... 34/380, 381, 412, 417, 497; 165/95; 62/126; 414/217, 805; 29/602.1, 605
See application file for complete search history.

(56) References Cited

U.S. PATENT DOCUMENTS

| | | | |
|---|---|---|---|
| 1,801,687 | A | 4/1931 | Pelphrey |
| 2,168,154 | A | 3/1938 | Camilli |
| 2,300,910 | A | 9/1940 | Camilli |
| 2,512,897 | A | 6/1950 | David |
| 2,656,290 | A | 10/1953 | BerBerich et al. |

(Continued)

FOREIGN PATENT DOCUMENTS

| | | |
|---|---|---|
| DE | 19 501 323 | 7/1996 |
| JP | 61174707 | 8/1986 |

(Continued)

OTHER PUBLICATIONS

Methodology for Comparison of Hydraulic and Thermal Performance of Alternative Heat Transfer Fluids in Complex Systems by Ghajar, Tang and Beam vol. 16, Issue 1, Jan.-Mar. 1995, in Heat Transfer Engineering.

*Primary Examiner* — Steve M Gravini
(74) *Attorney, Agent, or Firm* — Breneman & Georges

(57) ABSTRACT

A method for improving the manufacture and reliability of new, remanufactured, repaired or reconditioned Fire Control Radar APG-68 tactical radar systems (FCR) utilized in military aircraft and providing such units with extended useful life expectancies equivalent to or better than new of the FCR APG-68 unit high frequency, high voltage dual mode radar transmitters that are deployed in over 1000 state-of-the-art military aircraft such as the F-15, F-16 and F-18 fighter aircraft, and B-1 bombers. The novel method extends the mean lifetime of previously repaired and repairable FCR APG-68 tactical radar units and radar units and ageing transmitters from about 100 to a few hundred hours to about five hundred or more hours by the process of removing embedded moisture and absorbed moisture from the heterogeneous electronic components and preferably also removing contaminants from the heat transfer surfaces of the cold plates and heat exchangers in the FCR APG-68 tactical radar unit.

24 Claims, 19 Drawing Sheets

(56) References Cited

U.S. PATENT DOCUMENTS

| | | | | |
|---|---|---|---|---|
| 3,138,773 | A | 6/1964 | Nichols et al. | |
| 3,192,643 | A | 7/1965 | Antoine | |
| 3,233,311 | A | 2/1966 | Giegerich, at al. | |
| 3,259,991 | A | 7/1966 | Illich, Jr. | |
| 3,262,212 | A | 7/1966 | DeBuhr | |
| 3,271,874 | A | 9/1966 | Oppenheimer | |
| 3,352,024 | A | 11/1967 | Mellor | |
| 3,382,586 | A | 5/1968 | Lorentzen | |
| 3,587,168 | A | 6/1971 | Kolator | |
| 3,742,614 | A | 7/1973 | Bettermann et al. | |
| 3,792,528 | A | 2/1974 | Schober | |
| 3,883,958 | A | 5/1975 | Filipe | |
| 3,940,860 | A | 3/1976 | Unterreiner | |
| 3,990,872 | A | 11/1976 | Cullen | |
| 4,081,914 | A | 4/1978 | Rautenbach et al. | |
| 4,240,453 | A | 12/1980 | Vial et al. | |
| 4,250,628 | A | 2/1981 | Smith et al. | |
| 4,261,097 | A | 4/1981 | Weisse | |
| 4,347,671 | A | 9/1982 | Dias et al. | |
| 4,424,633 | A | 1/1984 | Bernhardt et al. | |
| 4,426,794 | A | 1/1984 | Vanderheijden | |
| 4,437,082 | A | 3/1984 | Walsh et al. | |
| 4,468,866 | A | 9/1984 | Kendall | |
| 4,547,977 | A | 10/1985 | Tenedini et al. | |
| 4,567,847 | A | 2/1986 | Linner | |
| 4,594,082 | A | 6/1986 | Catherwood, Sr. | |
| 4,594,629 | A | 6/1986 | d'Alayer de Costemore d'Arc | |
| 4,597,188 | A | 7/1986 | Trappler | |
| 4,599,670 | A | 7/1986 | Bolton | |
| 4,619,054 | A | 10/1986 | Sato | |
| 4,620,248 | A | 10/1986 | Gitzendanner | |
| 4,622,446 | A | 11/1986 | Sugisawa et al. | |
| 4,642,715 | A | 2/1987 | Ende | |
| 4,676,070 | A | 6/1987 | Linner | |
| 4,684,510 | A | 8/1987 | Harkins | |
| 4,742,623 | A | 5/1988 | Meurer et al. | |
| 4,742,690 | A | 5/1988 | Linner | |
| 4,745,771 | A | 5/1988 | Linner et al. | |
| 4,747,960 | A | 5/1988 | Freeman et al. | |
| 4,780,964 | A | 11/1988 | Thompson, Sr. | |
| 4,787,154 | A | 11/1988 | Titus | |
| 4,799,361 | A | 1/1989 | Linner | |
| 4,823,478 | A | 4/1989 | Thompson, Sr. | |
| 4,831,475 | A | 5/1989 | Kakuda et al. | |
| 4,863,499 | A | 9/1989 | Osendorf | |
| 4,882,851 | A | 11/1989 | Wennerstrum et al. | |
| 4,893,415 | A | 1/1990 | Moldrup | |
| 4,924,601 | A | 5/1990 | Bercaw | |
| 4,977,688 | A | 12/1990 | Roberson et al. | |
| 5,024,830 | A | 6/1991 | Linner | |
| 5,044,165 | A | 9/1991 | Linner et al. | |
| 5,115,576 | A | 5/1992 | Roberson et al. | |
| 5,122,633 | A | 6/1992 | Moshammer et al. | |
| 5,143,626 | A | 9/1992 | Nugent | |
| 5,173,155 | A | 12/1992 | Miyata et al. | |
| 5,189,581 | A | 2/1993 | Schroder et al. | |
| 5,289,641 | A | 3/1994 | Balamuta et al. | |
| 5,298,261 | A | 3/1994 | Pebley et al. | |
| 5,353,519 | A | 10/1994 | Kanamaru et al. | |
| 5,430,956 | A | 7/1995 | Lange | |
| 5,433,020 | A | 7/1995 | Leech | |
| 5,453,897 | A | 9/1995 | Bakerman | |
| 5,477,623 | A | 12/1995 | Tomizawa et al. | |
| 5,536,921 | A | 7/1996 | Hedrick et al. | |
| 5,634,281 | A | 6/1997 | Nugent | |
| 5,732,478 | A | 3/1998 | Chapman et al. | |
| 5,734,521 | A | 3/1998 | Fukudome et al. | |
| 5,752,532 | A | 5/1998 | Schwenkler | |
| 5,789,044 | A | 8/1998 | Ram et al. | |
| 5,846,696 | A | 12/1998 | Ram et al. | |
| 5,857,264 | A | 1/1999 | Debolini | |
| RE36,796 | E | 8/2000 | Sato et al. | |
| 6,146,884 | A | 11/2000 | Coonrod et al. | |
| 6,163,976 | A | 12/2000 | Tada et al. | |
| 6,164,039 | A | 12/2000 | Ram et al. | |
| 6,226,887 | B1 | 5/2001 | Tenedini et al. | |
| 6,272,770 | B1 | 8/2001 | Slutsky et al. | |
| 6,286,524 | B1 | 9/2001 | Okuchi et al. | |
| 6,311,509 | B1 | 11/2001 | Cartwright et al. | |
| 6,515,827 | B1 | 2/2003 | Raymond et al. | |
| 6,543,154 | B2 | 4/2003 | Horigane | |
| 6,543,155 | B2 | 4/2003 | Horigane | |
| 6,550,259 | B2 | 4/2003 | Cartwright et al. | |
| 6,587,307 | B1 | 7/2003 | Raymond et al. | |
| 6,591,515 | B2 | 7/2003 | Kinard et al. | |
| 6,640,462 | B1 | 11/2003 | Choi et al. | |
| 6,884,866 | B2 | 4/2005 | Bronshtein et al. | |
| 6,893,530 | B2 | 5/2005 | Kishimoto | |
| 6,922,912 | B2 | 8/2005 | Phillips | |
| 7,050,837 | B2 | 5/2006 | Menz et al. | |
| 7,061,362 | B2 | 6/2006 | Myers et al. | |
| 7,210,246 | B2 | 5/2007 | van der Meulen | |
| 7,219,442 | B2 | 5/2007 | Laible | |
| 7,234,247 | B2 | 6/2007 | Maguire | |
| 7,322,225 | B2 | 1/2008 | Gerbi et al. | |
| 7,347,007 | B2 | 3/2008 | Maguire | |
| 7,422,406 | B2 | 9/2008 | van der Meulen | |
| 7,458,763 | B2 | 12/2008 | van der Meulen | |
| 7,485,612 | B2 | 2/2009 | Takashima | |
| 7,748,137 | B2 | 7/2010 | Wang | |
| 7,789,970 | B2 | 9/2010 | Rosin | |
| 7,877,895 | B2 | 2/2011 | Otsuka et al. | |
| 7,959,403 | B2 | 6/2011 | van der Meulen | |
| 8,056,256 | B2 * | 11/2011 | Slack et al. | 34/403 |
| 8,082,681 | B2 * | 12/2011 | Slack et al. | 34/408 |
| 8,505,212 | B2 * | 8/2013 | Slack et al. | 34/403 |
| 2003/0183929 | A1 | 10/2003 | Boguslavsky | |
| 2010/0064541 | A1 | 3/2010 | Slack et al. | |
| 2010/0095504 | A1 | 4/2010 | Slack et al. | |
| 2013/0118709 | A1 * | 5/2013 | Slack et al. | 165/95 |

FOREIGN PATENT DOCUMENTS

| | | |
|---|---|---|
| JP | 02143418 | 6/1990 |
| JP | 03006203 | 1/1991 |
| JP | 04100256 | 4/1992 |
| JP | 05029265 | 2/1993 |
| JP | 05306478 | 11/1993 |
| JP | 06104224 | 4/1994 |
| JP | 06119896 | 4/1994 |
| JP | 06157175 | 6/1994 |
| JP | 07142445 | 6/1995 |
| JP | 09231936 | 9/1997 |
| JP | 11102829 | 4/1999 |
| JP | 11329328 | 11/1999 |
| JP | 2000040880 | 2/2000 |

* cited by examiner

| Date & Time | Days | Hours Under Vacuum at Temperature |
|---|---|---|
| 1/17/08 13:10 | | |
| 1/17/08 13:39 | 0.0201 | 0.48 |
| 1/17/08 13:59 | 0.0340 | 0.82 |
| 1/17/08 14:18 | 0.0472 | 1.13 |
| 1/17/08 15:30 | 0.0972 | 2.33 |
| 1/17/08 15:38 | 0.1028 | 2.47 |
| 1/18/08 12:02 | 0.9528 | 22.87 |
| 1/19/08 16:07 | 2.1229 | 50.95 |
| 1/21/08 11:10 | 3.9167 | 94.00 |

| Hours B-1 Initial Evacuation @ 85 C. | mT/Min. | mg/Min. |
|---|---|---|
| 0.48 | 106.7 | 80.0 |
| 0.82 | 84.7 | 63.5 |
| 1.13 | 63.9 | 47.9 |
| 2.33 | 42.5 | 31.9 |
| 2.47 | 37.5 | 28.1 |
| 22.87 | 21.4 | 16.1 |
| 50.95 | 3.16 | 2.4 |
| 94.00 | 1.26 | 0.9 |

First Redrying of B-1 after 3 Days Exposure to Shop Atmosphere

| Days | Hours | mT/Min. | gm. | mg / min. |
|---|---|---|---|---|
| 1/24/08 13:45 B-1 into Chamber | | | | |
| 1/24/08 14:30 Chamber Evacuated | | | | |
| 1/24/08 16:52 | 0.09861 | 2.37 | 10.50 | 1.02 | 7.9 |
| 1/24/08 18:24 | 0.16250 | 3.90 | 7.00 | | 5.3 |
| 1/25/08 11:13 | 0.86319 | 20.72 | 2.00 | | 1.5 |

First Redrying of B-1 at 85 C. after 3 Days Exposure to Shop Atmosphere

Second Redrying of B-1 after ~3 Days Additional Exposure to Shop Atmosphere

| Days | Hours | mT/Min. | gm | mg / min |
|---|---|---|---|---|
| 1/28/08 9:25 B-1 Into Chamber | | | | |
| 1/28/08 10:15 Chamber Evacuated | | | | |
| 1/28/08 10:47 | 0.02222 | 0.53 | 51.00 | 38.3 |
| 1/28/08 11:22 | 0.04653 | 1.12 | 25.50 | 19.1 |
| 1/28/08 11:52 | 0.06736 | 1.62 | 16.00 | 12.0 |
| 1/28/08 12:22 | 0.08819 | 2.12 | 11.00 | 8.3 |
| 1/28/08 13:25 | 0.13194 | 3.17 | 7.54 | 5.7 |
| 1/28/08 14:40 | 0.18403 | 4.42 | 4.00 | 3.0 |
| 1/28/08 15:22 | 0.21319 | 5.12 | 4.00 | 3.0 |
| 1/28/08 16:22 | 0.25486 | 6.12 | 3.50 | 1.47 | 2.6 |

2nd Redrying of B 1 @ 85 C. after ~3 Days Additional Exposure

Third Redrying of B-1 after 7 Days Additional Exposure

| Days | Hours | mT/Min. | gm | mg/Min |
|---|---|---|---|---|
| 2/4/08 11:30 Reached Temperature at 70 Deg. C. | | | | |
| 2/4/08 12:35 | 0.04514 | 1.08 | 65.00 | 48.8 |
| 2/4/08 17:30 | 0.25000 | 6.00 | 6.70 | 5.0 |
| 2/5/08 10:30 | 0.95833 | 23.00 | 1.64 | 1.2 |
| 2/6/08 11:13 | 1.98819 | 47.72 | 0.51 | 2.93 | 0.4 |

3rd Redrying of B-1 (@ 70 C.) after 7 Days Additional Exposure to Shop Atmosphere

Fourth Redrying of B-1 after 6 Days Additional Exposure

| | Days | Hours | mT/Min. | gm | mg / min. |
|---|---|---|---|---|---|
| 2/12/08 12:20 | Reached Temperature at 60 Deg. C. | | | | |
| 2/12/08 12:50 | 0.02083 | 0.50 | 50 | | 37.5 |
| 2/12/08 13:04 | 0.03056 | 0.73 | 30 | | 22.5 |
| 2/12/08 14:43 | 0.09931 | 2.38 | 10 | | 7.5 |
| 2/12/08 17:53 | 0.23125 | 5.55 | 5.33 | | 4.0 |
| 2/13/08 12:29 | 1.00625 | 24.15 | 1 | | 0.8 |
| 2/13/08 15:48 | 1.14444 | 27.47 | 1 | | 0.8 |
| 2/14/08 10:18 | 1.91528 | 45.97 | 0.29 | 1.3 | 0.2 |

4th Redrying of B-1 (@60 C.) after 6 Days Additional Exposure to Shop Atmosphere

METHOD FOR CLEANING AND RECONDITIONING FCR APG-68 TACTICAL RADAR UNITS

CROSS REFERENCE TO RELATED APPLICATIONS

The subject matter of this continuation in part application is related to the subject matter of U.S. application Ser. No. 13/373,385 filed Nov. 14, 2011 and U.S. application Ser. No. 12/256,447 filed Oct. 22, 2008 now U.S. Pat. No. 8,082,681 and U.S. application Ser. No. 12/212,623 filed Sep. 17, 2008 now U.S. Pat. No. 8,056,256.

STATEMENT REGARDING FEDERALLY SPONSORED RESEARCH OR DEVELOPMENT

Not applicable.

INCORPORATION BY REFERENCE OF MATERIAL SUBMITTED ON COMPACT DISC

Not applicable.

REFERENCE TO A "MICROFICHE APPENDIX"

Not applicable.

BACKGROUND OF THE INVENTION

1. Field of the Invention

The invention pertains to a method and system for conditioning, cleaning and reconditioning or processing a heterogeneous collection of electronic components in a Fire Control Radar (FCR) high frequency, high voltage dual mode radar transmitter used in state-of-the-art military aircraft including the F-15, F-16, F-18 and B-1 bombers. More particularly the invention relates to a method and system for cleaning heat transfer surfaces of previously repaired and repairable FCR APG-68 tactical radar units and for removing embedded moisture and absorbed moisture in newly manufactured and assembled units as well as from previously repaired and repairable FCR APG-68 tactical radar units to improve their normal life or to increase their normal repaired operational life from a few hundred hours or less to an expected life of about 500 hours or greater.

In one embodiment of the invention the novel method involves cleaning the repaired units by forcing cleaning fluid through the air passages of the cold plates and heat exchangers of the transmitters to remove debris from air passages prior to extensive drying of repaired units. As described herein the step of forcing a cleaning fluid includes forcing cleaning fluid in one end with positive or negative pressure and removing the fluid at the other end with a positive or negative pressure differential. The step of forcing a cleaning solution also includes forcing an aerated cleaning solution.

In another embodiment of the invention moisture is removed from newly manufactured units by extensive drying. In all embodiments extensive drying is achieved without damaging the heterogeneous collection of electronic components in the FCR APG-68 tactical radar units by utilizing temperatures between 40 and 105 degrees Celsius for periods of time from about 2 hours to 96 hours and preferably 4 to 48 hours when employing a vacuum pressure between 0.1 Torr and 10,000 milliTorr and preferably below 100 milliTorr and then sealing such electronic components or reassembling and filling the FCR APG-68 tactical radar unit with dry gas within about 1 to 30 minutes and preferably less than 5 minutes after treatment and while the unit is still warm or above 50° C.

In a further embodiment of the invention the novel method involves removing absorbed and some adsorbed moisture from the heterogenous collection of components in new units or units which have not accumulated significant amounts of embedded moisture. These units are generally new units, units that have been recently treated in accordance with the alternative embodiment of the invention to remove embedded moisture or units that have not been repeatedly repaired and left exposed to moisture-laden environments or atmospheres. Units treated in accordance with this embodiment of the invention are treated by removing the pneumatic fill valve generally referred to as a Schrader valve and the pressure relief valve and placing the new, recently remanufactured or repaired unit in a heating and evacuation chamber at a temperature of from about 40 to 100° C. and preferably 70° C. to 85° C. for a period of about 2 to 24 hours and preferably about 3 to 4 hours at a pressure less than 750 milliTorr and preferably less than 100 milliTorr. This application of the invention removes volatiles and adsorbed and lightly absorbed moisture and reduces the total moisture content of new, recently repaired or remanufactured units that have been treated to remove embedded moisture or units that have not been exposed to moisture-laden environments or atmospheres.

In an alternative embodiment of the invention new units or units that have been treated in accordance with the alternative embodiment of the invention to remove embedded moisture or units that have not been repeatedly repaired in moisture-laden environments may be treated in a heating chamber which has a vacuum line communicating with the pneumatic fill valve port and the pressure relief port of an assembled tactical radar unit which has been placed in a heating chamber. This alternative method of the invention eliminates the need for a combined heating and evacuation chamber and allows for the heating of the heating chamber at a temperature of about 40° C. to 100° C. and preferably at about 70° C. to 85° C. for a period of about 2 hours to 24 hours as the vacuum line attached to the fill valve port and the pressure relief port is evacuated to a pressure of less than 750 milliTorr and preferably less than 100 milliTorr.

2. Description of Related Art Including Information Disclosed Under 37 C.F.R. 1.97 and 1.98

High power radar transmitters fail periodically in service and are returned to depots for repair. At the depots the sulfur hexafluoride ($SF_6$) is removed from the high voltage high frequency power supply or high voltage section, which is enclosed in a sealed pressure vessel of the FCR APG-68 tactical radar dual mode transmitter. The pressure vessel is then opened and the electronic components within the high voltage section are exposed to the atmosphere of the shop while the failed component(s) are being located and replaced. The system is sometimes left open for days and even weeks. After reassembly the high voltage electronic package is subjected to tests at high voltage while immersed in a bath of volatile dielectric fluid such as Fluorinert™ and subsequently is sealed Into the pressure vessel, which is then evacuated, heated and dried under vacuum and refilled with sulfur hexafluoride ($SF_6$). After being tested the transmitter is returned to service.

It has been discovered by the inventors that the prior art evacuation heating and drying procedures removed only superficial moisture, were not effective in removing residual volatile dielectric fluids such as Fluorinert™. It has also been found that cleaning procedures to restore the heat transfer characteristics of the cold plate and heat exchanger have not been employed by the prior art. It has also been discovered by the inventors that removal of debris from and a through cleaning of the cold plate and the heat exchanger can also play a significant role in the operational life of tactical radar dual mode transmitters.

One of the other problems not recognized in the prior art is that ground testing did not simulate long period testing under actual temperature conditions encountered in flight operations. Ground testing, while adequate for demonstrating operability of the reassembled unit, did not include actual operational conditions where high ground temperatures followed by rapid low temperature flight conditions resulted in changes in vapor pressure inside the sealed unit that are caused by two types of moisture, adsorbed moisture and embedded moisture left in the unit, that reduce the life of the FCR APG-68 unit in service.

The best known prior art involves the original manufacture of the FCR APG-68 dual mode transmitters. In the original manufacture of the transmitters the partially assembled electronic assemblies (FIG. 6) were tested for corona discharge and other electrical characteristics while immersed in baths of Fluorinert™, then washed with Fluorinert™ to remove contaminants, from the electronic components as opposed to the heat exchanger components which electronic components were then dried and sealed into pressure vessels. After assembly the pressure vessels were evacuated to remove air so that they could be filled with sulfur hexafluoride ($SF_6$). Fluorinert™ evaporates without leaving any residue, but has a boiling point such that not all of it evaporates immediately. At first Fluorinert™ residues contaminated the oil of vacuum pumps used for the subsequent evacuation and interfered with reaching a vacuum level in the milliTorr range. This problem was eliminated by adding the step of vacuum baking the electronic assemblies to remove Fluorinert™ prior to sealing the assemblies within the pressure vessels, evacuating the pressure vessels and filling them with $SF_6$.

As manufactured relatively early in the FCR APG-68 program, the High Voltage, High Frequency Power Supply unit shown in FIG. 6 was vacuum-baked in an inverted position for about two hours, then its cold plate 50 (FIG. 5 and FIG. 6) was sealed to the aluminum high voltage pressure vessel 42 (FIG. 4) by means of an O-ring located just inside of the bolts 46 (FIG. 3). The closing and sealing was carried out while the assembly was still warm and was surrounded by an atmosphere consisting largely of nitrogen. This open vacuum-baking process unknowingly and unwittingly removed a lot of the moisture originally present in the components and absorbed during initial manufacture. Once repaired any moisture left at the time of original manufacture combined with the moisture absorbed from the atmosphere during the current repair which also added to the moisture adsorbed during previous repair operations to form harmful absorbed and embedded moisture that resulted in decreasing mean time between failures (MTBF).

In the prior art repair process Fire Control Radar FCR APG-68 units are repaired and a final process performed on repaired transmitters is to evacuate them through a Schrader valve and a Schrader valve actuator while they are being heated and then to backfill the high voltage high frequency power supply sealed within its enclosing pressure vessel with $SF_6$. The vacuum is drawn through passages in the Schrader valve that are only about 0.060 inch in diameter and whose conductance is, therefore, very low. As a result it is believed that only a small amount of moisture and possibly only the moisture already in the air within the pressure vessel is removed at the time of evacuation and heating. The bulk of the moisture that has been absorbed from the atmosphere in the shop during the repair process remains embedded in the various electronic components, largely in organic insulating materials and builds up as embedded moisture as a consequence of repeated repairs.

Over the last twenty years the mean-time-between-failure (MTBF) of the transmitters has been falling from over 500 hours of operational life to values in the low hundreds of hours. Frequently transmitters now fail after only a few tens of hours of operation after having been serviced and ground tested. Many of the FCR APG-68 units have therefore been repaired dozens of times with each repair likely adding to the total moisture embedded in the high voltage high frequency power supply.

In addition many of the FCR APG-68 units have been repeatedly repaired and in service for thousands of hours. Some of this time has been spent on runways and in dusty locations with insects and residue from spent jet fuel. Dust-laden and residue from spent jet fuel air has been drawn through the heat transfer passages of the cold plate 50 (FIG. 3) and of the heat exchangers used to cool the Coolanol™. This dirty air and other debris has contaminated and accumulated on the heat transfer surfaces. Such contamination reduces the cooling capacity of the cold plates and heat exchangers, resulting in hot spots and an increase in the operating temperatures of the electronic components mounted to and cooled by the cold plate 50 (FIG. 6) as well as an increase in the temperature of the Coolanol™ used to cool the TWT.

The best known prior art which was employed during the original manufacturing process did not have as its primary purpose the removal of moisture and did not specifically quantitatively test for moisture removed. The prior art process of removing Fluorinert™ is believed to have unwittingly and unknowingly removed much of the moisture absorbed during the manufacturing process as well as dust and debris left in the heat exchanger, leaving a quantity of tolerable moisture as well as a relatively clean heat exchanger. This tolerable moisture included intrinsic moisture that could not be removed without removing volatile organic plasticizers and organic materials. This tolerable moisture and intrinsic moisture did not significantly impair the normal expected 500 hour MTBF rate. The standard practice of heating and evacuation through the Schrader valve at vacuums typically of 2 Torr does not remove the bulk of the moisture absorbed during the immediately preceding repair operation and is believed not to remove embedded moisture or moisture that was absorbed during previous repair operations.

The invidious nature of the absorbed and embedded moisture in the high voltage high frequency power supply was first recognized by the inventors after discovering the surprising amount of water removed from a high voltage high frequency power supply from an FCR APG-68 defective unit from a B-1 bomber as will be described hereinafter in greater detail. The amount of water removed as moisture is believed to have been deeply embedded in the organic components of the high voltage high frequency power supply. On the ground at a constant temperature the moisture content of the vapor space in the pressure vessel approaches an equilibrium with the moisture content of the organic and inorganic solid state materials in the high voltage high frequency power supply.

The time between flights would allow this equilibrium to be approached at sometimes high ground temperatures. However the rapid change in temperature encountered in flight level altitudes which change at about 1.4 degrees Centigrade per 1,000 feet can drop temperatures by 15° C. in about 10 seconds. Such a rapid cooling due to a rapid change in altitude results in a rapid rise in the relative humidity in the sealed high voltage high pressure vessel. As the relative humidity in the pressure vessel rises rapidly and exceeds 100% condensation would occur resulting in arcing, partial discharges and failure of the FCR APG-68 dual mode transmitter.

The deleterious effect of moisture on the electrical components and properties of insulators is well known. Camilli U.S. Pat. No. 2,300,910 refers to the vacuum treatment and drying to remove all moisture prior to the impregnation of the paper insulation in high voltage windings of transformers during their manufacture. Similarly, Camilli U.S. Pat. No. 2,168,154 provides for drying of the core and windings of a transformer in a partial vacuum and Kolator U.S. Pat. No. 3,587,168 provides for the use of heat and vacuum in the manufacture of transformers. Temperatures in the range used for transformers are beyond the range that are tolerated by FCR APG-68 tactical radar units.

Many methods have been proposed for the drying of electronic components during manufacture such as Wennerstrum U.S. Pat. No. 4,882,851 which discloses the use of microwave heating. Microwave heating cannot be applied to an assembled FCR APG-68 tactical radar dual mode transmitter. Other prior art such as Schroder U.S. Pat. No. 5,189,581 discloses use of a desiccant for removing moisture from the housing of a videocassette recorder.

Leech U.S. Pat. No. 5,433,020 discloses use of a cold trap with a valve between vacuum pump and trap to maintain a fixed differential pressure to control flow rate during the vacuum drying of an object. In contrast the system of the invention employs a valve between cold trap and vacuum chamber to permit measurement of the rate of evolution of embedded and absorbed moisture.

Schober U.S. Pat. No. 3,792,528 dries windings of high voltage transformers, seals them, washes out the sealant and dries the transformer with kerosene vapor before filling with transformer oil. Kerosene vapor cannot be employed to dry FCR APG-68 tactical radar transmitters because of the difficulty in complete removal of the kerosene prior to filling with $SF_6$.

Inoue Tamotsu JP 61 174 707 improves the dielectric strength of the gas of a gas-filled transformer by intermittently circulating the gas through an external drier. This is not practical in an air-borne FCR APG-68 dual mode radar transmitter because the length of time required is so much greater than through the use of vacuum.

Ikuyo and Hiroyuki JP 11 329 328 employs a preliminary chamber to remove surface moisture by electron beam processing and applies heat and vacuum. Subsequently the samples are moved to a separate chamber. It is not practical to move units from one chamber to another for separate treatment due to the reacquisition of atmospheric moisture.

Michio, et al. JP 1110 2829 reduces the rate at which paper insulation deteriorates by heating electrical equipment under vacuum by passing current through the windings. This method of heating the windings is not practical for radar components within the high voltage section, which involve many different components other than transformer windings. Similarly Gmeiner Paul (DE 19 501 323) dries transformers and treats the oil by heating with current through the coils.

Boguslaysky US 2003 0183929 thermally conditions components on IV packages before and/or after repairing them in order to prevent moisture from damaging the packages when subsequently subjected to soldering temperatures. The need to maintain dryness of electrical packages that will be exposed to soldering temperatures for purposes of soldering is very different from removing moisture from FCR APG-68 radar transmitter units to increase their operational life. Dias U.S. Pat. No. 4,347,671 dries the interior of metal surfaces such as tubing for high purity gases by passing through a reactive gas; such a procedure would damage the components of a high voltage high frequency power supply.

The premature failures of repaired FCR APG-68 units have resulted in extensive investigations in the prior art. Arcing and partial discharge and failure have been attributed to the contamination of Coolanol™ which is used as a circulating coolant for the FCR APG-68 tactical radar unit as well as to the contamination of the sulfur hexafluoride gas in the high voltage high frequency power supply.

It has been found by the inventors that failed FCR APG-68 tactical radar units contain contaminated Coolanol™ 25R exhibiting increased color, odor and viscosity and decreased resistivity and in extreme cases sludge. This sludge can be deposited on the heat exchanger surfaces or in the traveling wave tube (TWT). As a result the heat transfer coefficient and the flow rate can decrease because of the formation of solid contaminants that raise the temperature of the TWT, which accelerates the decomposition of the Coolanol™ 25R and the eventual malfunction of the FCR APG-68 tactical radar unit.

Those skilled in the art of FCR APG-68 tactical radar units have extensively investigated Coolanol™ 25R as a source of the problems of arcing, the creation of hot spots and the failure of FCR APG-68 tactical radar units. One study involved the replacement of Coolanol™ 25R with polyalphaolefin under the title Coolanol 25R Replacement for Military Aircraft Cooling Systems AF06-083, which contract was awarded to METSS Corporation of Westerville, Ohio and an Article entitled *Methodology for Comparison of Hydraulic and Thermal Performance of Alternative Heat Transfer Fluids in Complex Systems*, By Ghajar, Tang and Beam, Vol. 16, Issue 1 January-March 1995 *Heat Transfer Engineering*.

Those skilled in the art have also investigated the FCR APG-68 tactical radar unit as a function of the purity of sulfur hexafluoride ($SF_6$) or its contamination. $SF_6$ purity is important since the electronics package of the high voltage high frequency unit is sealed in an atmosphere of $SF_6$. There is however disagreement in the literature on the effect of moisture on the behavior of $SF_6$ in arcing and corona discharge.

In the prior art heat transfer surfaces in TWT's and in heat exchangers that are in contact with the liquid heat transfer medium Coolanol™ 25R have been at least partially cleaned by circulation of Coolanol™ through filters during fluid replacement. No means have been employed in the prior art to clean heat transfer surfaces that are in contact with air or residue from Coolanol™ or other fluids used during the original manufacture or repair processes. In APG-68 tactical radar units other than those used in B-1 bombers, heat is transferred from electronic components mounted on a cold plate to air flowing through channels in said cold plate and heat is transferred from Coolanol™ to air in heat exchangers. These heat transfer surfaces in contact with air accumulate films with increasing amounts of dirt and debris and spent jet fuel hydrocarbons and residue with increasing service, resulting in reduced heat transfer, decreasing MTBF and eventual malfunction of the FCR APG-68 tactical radar units. Furthermore dirt, residue and contamination from these heat transfer surfaces has also in the prior art been transferred inadvertently to the surfaces of electronic components during the high voltage corona testing step that follows repair operations.

The deleterious effect of excessive temperature on electronic components is well known, as is the adverse effect of dirt and other contaminants on the transfer of heat through surfaces of heat exchangers. Rosin U.S. Pat. No. 7,789,970 optimizes the cleaning of heat exchange surfaces by measuring the particles in the exhaust stream. Takashima U.S. Pat. No. 7,485,612 discloses an electronic parts cleaning solution that removes fine dust and organic matters adhered to the surface of electronic parts but employs chemicals that would be entirely unacceptable for use on parts of equipment subject to high voltages. Kishimoto U.S. Pat. No. 6,893,530 discloses a method and system for cleaning to remove cutting dust and the like adhering to board material and drying. The method involves repeatedly evacuating and backfilling with air, each evacuation proceeding to a lower pressure than the previous evacuation.

As a result those skilled in the art have considered various options to remedy the premature ageing and high rate of failure of FCR APG-68 tactical radar units. The initial cost of acquisition at almost one million dollars a unit and their reduced service life and requirements for repair and maintenance have provided a great incentive for finding an acceptable method or procedure for remediating and upgrading the performance of these vital tactical radar units.

In the prior art repair process Fire Control Radar FCR APG-68 units are repaired and as in the original manufacture of the transmitters during which the partially assembled electronic assemblies are tested for corona discharge in baths of Fluorinert™. In the original manufacture the units were also rotated in a bath of circulating Fluorinert™ to remove contaminants resulting from the repair process. The circulating Fluorinert™ employed in the original manufacture of the units was sufficient to remove any contamination left over from the original manufacture of the units but would be insufficient to clean units that have been in service. In the prior art no action was taken to clean the air-cooled heat transfer surfaces of repaired transmitters.

SUMMARY OF THE INVENTION

The FCR APG-68 tactical radar unit is an advanced pulse-Doppler radar having increased range and more modes than predecessor radar systems such as the FCR APG-66 radar units. The FCR APG-68 radar unit comes in a number of variants: the FCR APG-68 (V) 5, FCR APG-68 (V) 6, FCR APG-68 (V) 7, FCR APG-68 (V) 8 and FCR APG-68 (V) 9. The FCR APG-68 (V) 9 is to date the latest variation of the FCR APG-68 radar family and provides improved range and resolution and multimode fire control with improved search-while-track mode of four versus two targets and improved resistance to countermeasures. All members of the FCR APG-68 family provide the eyes of the advanced military fighter, bomber and tactical aircraft all of which include a high voltage power supply surrounded by sulfur hexafluoride ($SF_6$) in a sealed housing and cooled by contact with and conduction to a cold plate, to the bottom of which the electronic components are mounted.

All of the FCR APG-68 variants FCR APG-68 (V) 5 to FCR APG-68 (V) 9 have similar high voltage assemblies surrounded by sulfur hexafluoride ($SF_6$) and have the similar problem of decreased mean time between failure (MTBF). The invention is applicable to all FCR APG-68 variants, FCR APG-68 (V) 5 to FCR APG-68 (V) 9 and will be collectively referred to as a FCR APG-68 tactical radar unit hereinafter and in the claims. These FCR APG-68 tactical radar units can be reconditioned to have high MTBF values in accordance with the method of the invention.

All of the FCR APG-68 variants employ TWT's that are cooled by Coolanol™ which is in turn cooled by a heat exchanger. The Coolanol™ in most variants is cooled by air, but in some is cooled by fluid that has been cooled in external heat exchangers. Heat transfer surfaces of air cooled heat exchangers are exposed to the environment and in operation collect debris that interfere with the efficient operation of the heat exchanger.

It has been discovered that the electronic components have been exposed to higher temperatures after many hours of service than they would be exposed had the heat transfer surfaces in the cold plates and air-cooled heat exchangers been cleaned each time a transmitter was serviced. One embodiment of the invention provides for the vigorous cleaning of heat transfer surfaces that have been exposed to the environment to increase the MTBF values.

The inventors have discovered that by forcing cleaning fluid in the form of a vigorous spray or liquid through the air passages of the cold plates and heat exchangers under pressure or a vacuum significant quantities of solid contaminants are removed from the surfaces that during normal operation have been in contact with cooling air. Any number of different cleaning solutions known to those skilled in the art can be employed to remove dirt, residue from spent jet fuel and other debris including aqueous solutions which can be channeled only into the heat exchanger to avoid deleterious contact with the electronic components mounted on the cold plate. The solid contaminants that have been removed were deposited during the flow of dirty air through the cold plates and heat exchangers. Removal of contaminants by a through cleaning process of the invention increases the efficiency of the cooling system and increases MTBF values.

It has also been discovered that the amounts of embedded moisture in FCR APG-68 tactical radar units have resulted in high failure rates and premature ageing. This discovery of the volume of moisture actually removed from the high voltage high frequency unit was surprising since all electronic equipment contains trace amounts of moisture and prior art techniques of heating and evacuation were believed sufficient to remove sufficient quantities of moisture and to leave only such trace amounts of moisture as would not impair the operational capabilities or operational life of the Fire Control Radar (FCR) APG-68 tactical radar unit. In fact the method of the invention in the preferred embodiment stops removing moisture at a level that avoids removing intrinsic moisture as well as most plasticizers and impregnating oils in the insulating materials.

Limitations on the MTBF and useful operational life and operational capabilities of the FCR APG-68 unit are due to the presence of embedded moisture and absorbed moisture which also can be aggravated by the deterioration in the heat transfer coefficients between the cold plates and heat exchangers and the cooling fluids flowing through them and in the deposition of contaminants in operation. The presence of these types of moisture is believed not detected in standard testing after the unit is repaired, tested and returned to service because standard testing does not include repeated temperature cycling between high temperatures to which an aircraft is subjected on the ground and low temperatures encountered at high flight levels in operation. It is believed that temperature variations result in vapor pressure differentials that on the ground drive embedded moisture and absorbed moisture from the electronic components in the high frequency high voltage power supply which together with rapid cooling in flight which alone or in combination with contaminants deposited on cold plates and heat exchangers cause hot spots, arcing and partial discharges due to the moisture condensation or hot spots resulting in malfunctioning of the high voltage high frequency power supply.

The inventors have discovered that the contents of the high voltage high frequency power supply of the FCR APG-68 tactical radar units have absorbed very significant and hitherto unsuspected quantities of moisture from the atmospheres of the repair depots as the transmitters were being repaired—in spite of the drying and evacuation to which the FCR APG- 68 unit has been subjected prior to being recharged with $SF_6$. Over time this moisture is believed to become deeply embedded in the components of the high voltage section. This deeply embedded moisture becomes evident from the slow and decreasing rate at which it diffuses out of the assembly under vacuum at an elevated temperature of 70° C. Over ten grams of water have been removed from a single transmitter. This quantity of water is over 100 times the quantity required to establish a relative humidity of 50% in the free volume of the high voltage section at 25° C.

The quantity of embedded moisture absorbed in the high voltage section of a transmitter is many times that which can be accounted for by surface adsorption on components. The moisture is absorbed by the organic portions of the various components, which include transformers, coils, circuit boards, resistors, diodes, semiconductors, and especially insulating materials and components in the high voltage power supply. Some of the insulating material may contain cellulose. The insulation of high voltage transformers is normally oiled or resin-impregnated cellulose. These oil and resin-impregnation treatments only slow down the rate at which the cellulose portion absorbs and releases moisture.

The major components of the high voltage power supply section of the FCR APG-68 tactical radar unit from a B-1 bomber, from which 10 grams of water had been removed, subsequently absorbed 1.5 grams of moisture from the atmosphere of a typical shop in three days and 2.9 grams in seven days. This freshly absorbed moisture can be removed more rapidly than that which has been absorbed over the years since it has not had time to diffuse so deeply within the components. Freshly absorbed moisture and volatiles is being referred to herein as absorbed moisture and is easier to remove than embedded moisture which has remained in the high voltage high frequency power supply unit over repeated repair cycles.

For example, if 160 grams of dry cellulose contained the 10 grams of water that has been found in a power supply, its water content would be 6.25%, a value that it would reach if exposed for a long period of time to an atmosphere of 50% relative humidity at 20° C. If this cellulose were then sealed into a dry space of limited volume, such as the pressure vessel of a radar transmitter, water would desorb until the relative humidity reached about 35%. When the space was cooled down to 38° F. the space would be saturated with water vapor, with further cooling resulting in condensation.

In the field FCR APG-68 tactical radar units are subjected to rapid changes in temperature. The standard value for temperature as a function of altitude is 30.5° F. at only 8,000 feet. If necessary, an F-16 could reach this altitude in less than 10 seconds. Ambient conditions of high ground temperatures and low temperatures in flight are believed to result in increases in relative humidity or actual condensation in the sealed FCR APG-68 tactical radar unit that result in arcing, partial discharges and failure of the transmitter. The qualification tests on this transmitter when new involved warm-up times as short as 160 seconds and temperature cyclic tests during which power is turned on when the equipment has reached −54° C.

Due to the rapid changes in temperature in flight operations it is believed the embedded moisture has caused premature failure in FCR APG-68 tactical radar units. The failure and limited operational life of the FCR APG-68 tactical radar unit can be remedied in accordance with the invention by a through cleaning of the heat exchange surfaces and/or by removing the embedded moisture that causes arcing, partial discharges and failure and unreliability of the dual mode transmitter in operation by utilizing the method of the invention.

The amount of embedded moisture in the electronics package of the FCR APG-68 high frequency, high voltage dual mode radar transmitter was discovered when the power supply chassis with the electronic components hereinafter referred to as power supply chassis or high voltage power supply or high voltage high frequency power supply of a failed FCR APG-68 unit was heated and evacuated. The power supply chassis of the FCR APG-68 tactical radar unit was evacuated and heated for three days at a temperature of about 85° C. and the evolved gases were collected in a trap at a temperature of about −80° C. and about 10.3 grams of water were recovered.

During the drying the rates at which moisture was evolved were determined periodically by closing a valve between the vacuum oven and the cold trap and observing the rates at which the pressure built up. In this way it was possible to distinguish between embedded moisture and recently absorbed moisture as well as superficial moisture that does not affect the service life of the FCR APG-68 tactical radar unit. The embedded moisture as used herein is moisture absorbed by the power supply chassis from the atmosphere, after repeated repairs and openings and leaving the power supply chassis exposed to laboratory atmospheres for periods equivalent to several weeks, that has diffused to the interior of components over periods of time during which the unit was sealed. The embedded moisture may include trace amounts of moisture present when the FCR APG-68 tactical radar unit was originally manufactured. The absorbed moisture as used herein is moisture absorbed from the atmosphere during a repair but which moisture has not had time to diffuse deeply into the interior of components.

In accordance with the method of the invention embedded moisture and absorbed moisture that reduce the mean time between failure due to arcing, hot spots and destabilization of the traveling wave tube (TWT) can be remediated by the removal of the embedded moisture and absorbed moisture from the high voltage power supply and other volatiles. The embedded moisture and absorbed moisture in the high voltage power supply can be removed by separately treating the high voltage high frequency power supply from an FCR APG-68 tactical radar unit operated over a period of time at a temperature of from about 40° C. to 105° C. with a circulating drying gas and a cold trap to remove water. The circulating drying gas should be dry and substantially inert to the collection of electronic components in the power supply of the FCR APG-68 tactical radar unit. Dry nitrogen is preferred but other dry or inert gases may be used such as carbon dioxide or an inert gas such as argon and neon could be utilized.

The cold trap should be operated below 0° C. and preferably at or below minus 70° C. A suitable oven for treating a high voltage power supply can be obtained from Slack Associates, Inc. in Baltimore, Md. with a Model Number 1061. Other suitable commercially available ovens may be obtained or constructed from commercially drying ovens available from a variety of sources.

The heating oven used for separately treating the high voltage power supply from an FCR APG-68 tactical radar unit should also include the ability to be evacuated while heating to reduce the period of time the high voltage power supply from the FCR APG-68 tactical radar unit is treated. A suitable oven should be capable operated at or below 10 Torr and preferably at a range of about 50 to 100 milliTorr and filled with a dry gas to reduce the time required to remove embedded moisture from the high voltage power supply from an FCR APG-68 tactical radar unit. A suitable heating oven for reconditioning a high voltage power supply can be obtained from Slack Associates, Inc. of Baltimore, Md. having a Model No. 1061.

The high voltage power supply from the FCR APG-68 tactical radar unit preferably should be treated in a suitable heating oven at about 70° to 80° C. for a period of about 50 to 100 hours at a pressure of 10 Torr or less. The heating oven should preferably have a circulating fan which is used for about an hour until the load approaches the target temperature at which time the circulating fan is turned off and the chamber is evacuated. The drying time can be reduced by increasing the temperature up to about 105° C. and reducing the vacuum down to 1 milliTorr at which point drying times may be reduced to as little as 4 to 5 hours. Temperatures at or above 105° C. and pressures below 1 milliTorr risk the undesirable removal of excessive quantities of plasticizers and impregnating oils that may result in the destruction of the high voltage power supply for the FCR APG-68 tactical radar unit.

Once the high voltage power supply for the FCR APG-68 tactical radar unit is treated it should be vacuum sealed or sealed in a dry gas such as nitrogen, carbon dioxide, sulfur hexafluoride or a dry and inert gas such as argon or helium until the high voltage high frequency power supply is reassembled into the FCR APG-68 tactical radar unit. In such a case the high voltage high frequency power supply should be only opened and reassembled in a dry controlled atmosphere.

Alternatively and preferably the reconditioned high voltage power supply should be removed partially from the heating oven and reassembled and sealed to the FCR APG-68 tactical unit and filled with a dry gas within 1 to 30 minutes after treatment and preferably within 5 minutes to prevent the high voltage power supply from reabsorbing moisture from the atmosphere.

The invention in the preferred embodiment also includes a method for reconditioning an FCR APG-68 tactical radar unit in which one or more of electronic components in the high voltage high frequency power supply have been replaced or reconditioned. This method is included within the broader method for reconditioning the high voltage high frequency power supply assembly as heretofore described and includes placing the repaired high voltage power supply unit in a heating oven as heretofore and hereinafter described and evacuating the heating oven to below 10 Torr and preferably below 1 Torr and backfilling the heating oven with an inert dry gas such as nitrogen having a dew point below 5° C.

The preferred method for reconditioning a previously repaired unit processed in accordance with the invention or a unit which has had the embedded moisture previously removed is to use a temperature of about 70° C. instead of 80° C. and continue removing moisture under vacuum until the rate of moisture removal drops to a rate of 5 milligrams/minute and preferably 0.4 milligrams/minute by a cold trap maintained at or below minus 70° C. Preferably the rate of moisture removal is measured by a mass spectrometer or a metallized ceramic hygrometer. The rate of moisture removal should not be allowed to drop as low as 0.2 milligram per minute at 70° C. due to the possibility of removing excessive quantities of plasticizers and impregnating oils from the heterogenous assortment of electronic components in the high voltage power supply.

Once the rate of desorption of moisture reaches about 0.4 milligrams per minute at 70° C. or 2.0 mg/minute at 85° C. the heating oven should be opened with a continuing flow of dry inert gas. The sealing surface of the cold plate of the corresponding FCR APG-68 housing should be secured to the O-ring in a groove in the pressure vessel to seal it against the cold plate of the high voltage high frequency power supply unit while the temperature of the high voltage power supply is above 40° C. and preferably above 50° C. The DMT (dual mode transmitter) of the FCR APG-68 tactical radar unit should then be sealed or preferably backfilled with sulfur hexafluoride through its Schrader valve after being reevacuated.

In a further application and embodiment of the invention recently manufactured, remanufactured or repaired units can be treated to remove moisture from replacement or repaired components as well as ambient moisture introduced during the repair of tactical radar units. In new units or units that have not been repeatedly exposed to moisture during repair or have replacement components not known holding adsorbing or absorbing moisture a moisture removal process may be employed after the radar transmitter has been sealed within its pressure vessel.

In this embodiment of the invention the Schrader valve or the pressure relief valve and preferably both the Schrader valve and the nearby pressure relief valve are removed from the pressure vessel. Removal of both the Schrader valve and the nearby pressure relief valve is sufficient to permit sufficient conductance for the removal of surface moisture when the tactical radar unit is treated in accordance with the invention in a process chamber at a temperature of about 70 to 75° C. for a period of about four hours. Removal of only one valve limits conductance and necessitates additional considerations of time and temperature.

An example of the use of this process is the removal of surface moisture absorbed from the atmosphere during component replacement and repair operations or for newly manufactured units. When possible, it is convenient to remove moisture from a power supply of a radar transmitter after the latter has been sealed within its pressure vessel. The removal of moisture proceeds at a useful rate, however, only when there is appreciable conductance between the electronic components inside the pressure vessel and the evacuated space surrounding it. The very limited conductance available through an open Schrader valve is generally insufficient to permit removal of even the relatively small amount of moisture adsorbed during servicing within a period of time of a few hours. Therefore, a useful practice is to remove the pneumatic valve from the valve port which holds a valve such as a Schrader valve and the nearby pressure relief valve from the pressure vessel. The conductance through the resulting orifices in the wall of the pressure vessel is sufficient to permit removal of the surface moisture in a period of less than four hours at a temperature of 70 to 75° C.

In newly manufactured units or in units that have been previously processed in accordance with the invention and after a radar transmitter has been again serviced, the electronics are positioned within the pressure vessel, which is sealed by an O-ring. This sealing is conveniently accomplished while the transmitter is at room temperature. The Schrader valve communicating with the interior of the pressure vessel is then removed, as is the nearby pressure relief valve. The assembly is then placed in a process chamber. The chamber is maintained at a temperature of 70° C. to 75° C. The gas within the chamber at this point is a mixture of the nitrogen with which the chamber was most recently backfilled and air that has entered through the open chamber door. After closing and sealing the door of the chamber, a blower may be energized to increase the rate at which the temperature of the radar transmitter approaches the temperature of the chamber.

When the transmitter approaches the temperature of the chamber to within a few degrees, the blower, if employed, is deenergized and the chamber evacuated. A period of 30 minutes of heating by circulated air is normally sufficient. The temperature of the transmitter may be measured, but since transmitters heat up at a reproducible rate this is not required. As the chamber is evacuated, air diffuses from the interior of the pressure vessel to the chamber, through the orifices normally occupied by the Schrader valve and the pressure relief valve, at a rate such that the pressure in the vessel is only slightly greater than that in the chamber itself. The chamber pressure is optimally reduced to a pressure below 100 milliTorr and maintained there for two to three hours. Exposure for as much as four hours will not remove a very large proportion of the deeply embedded moisture that the electronic components may contain, but three hours will result in very complete removal of the moisture absorbed during the recent repair procedures.

In the event the repair processing involved immersion in an insulating fluid during high voltage testing, or if it employed cleaning of the components of the high voltage power supply by immersion or impingement of dielectric fluid such as Fluorinert™ or through the use of a more active solvent such as mineral spirits or if its cold plate had been cleaned by similar means and if the removal of such fluid, for example Fluorinert™ 770, has been incomplete, this fluid will also be removed by evaporation and diffusion. To protect the oil of any mechanical vacuum pump employed to produce the vacuum, it is desirable to interpose a cold trap operating at or below −40° C. between the chamber and said vacuum pump. It is good practice, after some minutes, for example half an hour, after the pressure in the chamber has fallen below 100 milliTorr, to close a valve between the chamber and the vacuum pumping system and observe or record the rate at which the pressure in the chamber increases over a period of a few minutes. A pressure rising at a rate less than 100 milliTorr per minute indicates that the vacuum within the pressure vessel itself has fallen to an acceptably low value. At the end of the several hours of evacuation at temperature, the chamber and the pressure vessel are backfilled to atmospheric pressure with dry nitrogen gas.

The chamber door is opened and the Schrader valve or other pneumatic valve of the Schrader type and the pressure relief valve are reinstalled while the radar transmitter is still hot and full of dry nitrogen. The subsequent evacuation of the pressure vessel through the Schrader valve prior to the vessel's being filled with sulfur hexafluoride need not be as complete as if the vessel had been filled with ambient air containing moisture.

The advantages and unobvious aspects of the invention will be further discussed with reference to the Drawings and Detailed Description of the Invention including Best Mode.

BRIEF DESCRIPTION OF THE DRAWINGS

The invention will be further described in reference to disclosure of the best mode in conjunction with the accompanying drawings which for ease of reference and understanding will include state of the art military aircraft and the FCR APG-68 advanced pulse Doppler radar as a background for understanding the method of the invention for reconditioning the FCR APG-68 tactical radar unit to remove embedded moisture in which.

DETAILED DESCRIPTION OF THE INVENTION INCLUDING BEST MODE

This invention pertains to the removal of moisture from recently manufactured, remanufactured or repaired units as well as older units that have been repeatedly repaired and require the removal of deeply embedded moisture and absorbed moisture absorbed from the atmosphere during repair from the components associated with the high voltage power supply sections of airborne FCR APG-68 tactical radar transmitters. The moisture is removed to a degree at which subsequent changes in temperature encountered by high performance military aircraft will not result in condensation of water in the high voltage high frequency power supply in the sealed pressure vessels of such Fire Control Radar (FCR) APG-68 tactical radar units.

Figure 14:
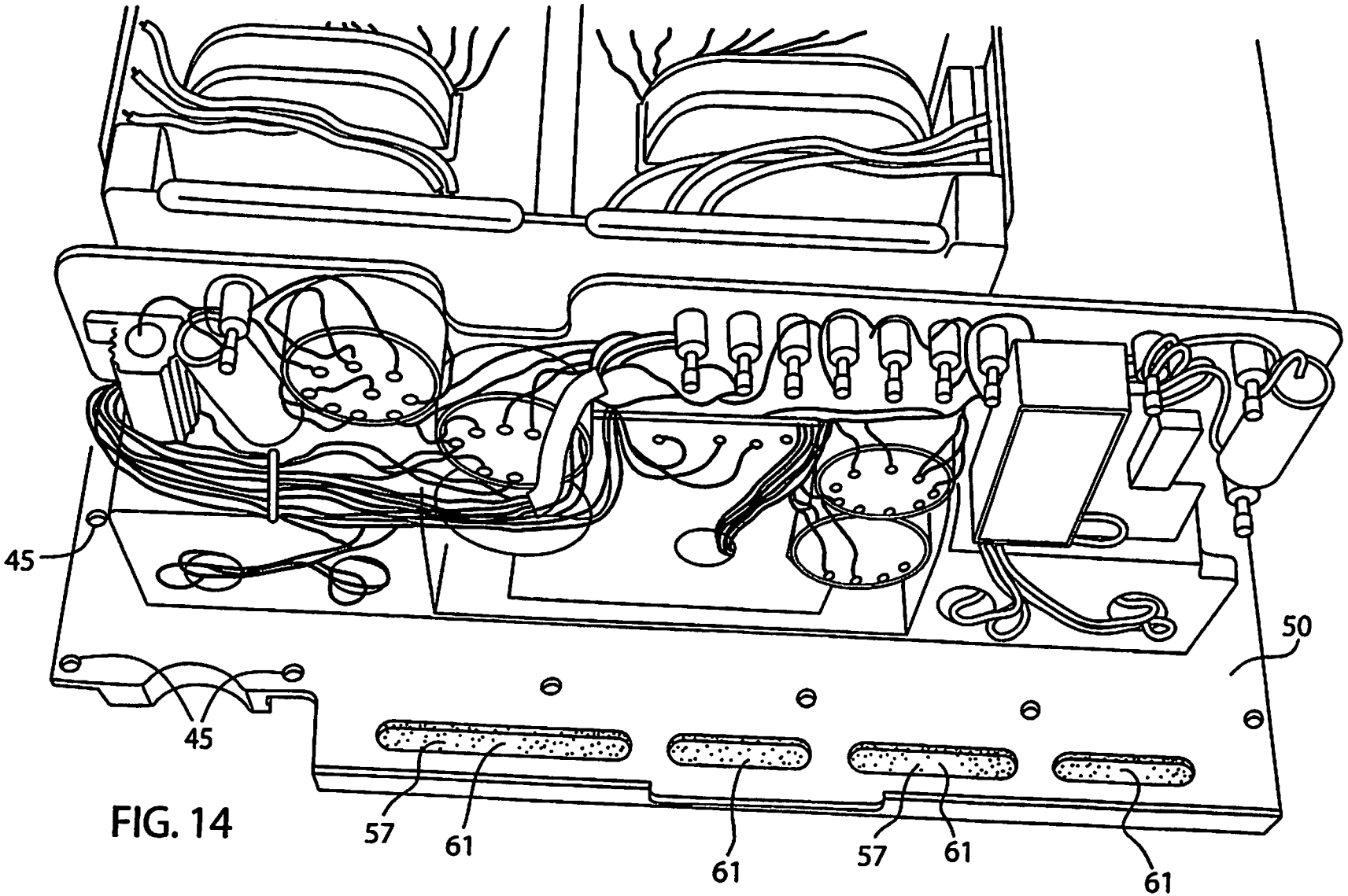
FIG. 14 is a perspective view of one end of a cold plate to which the electronic components of the power supply are mounted, showing the slots through which cooling air enters the cold plate during normal operation and through which cleaning fluid is introduced or withdrawn during cleaning operations.
Figure 15:
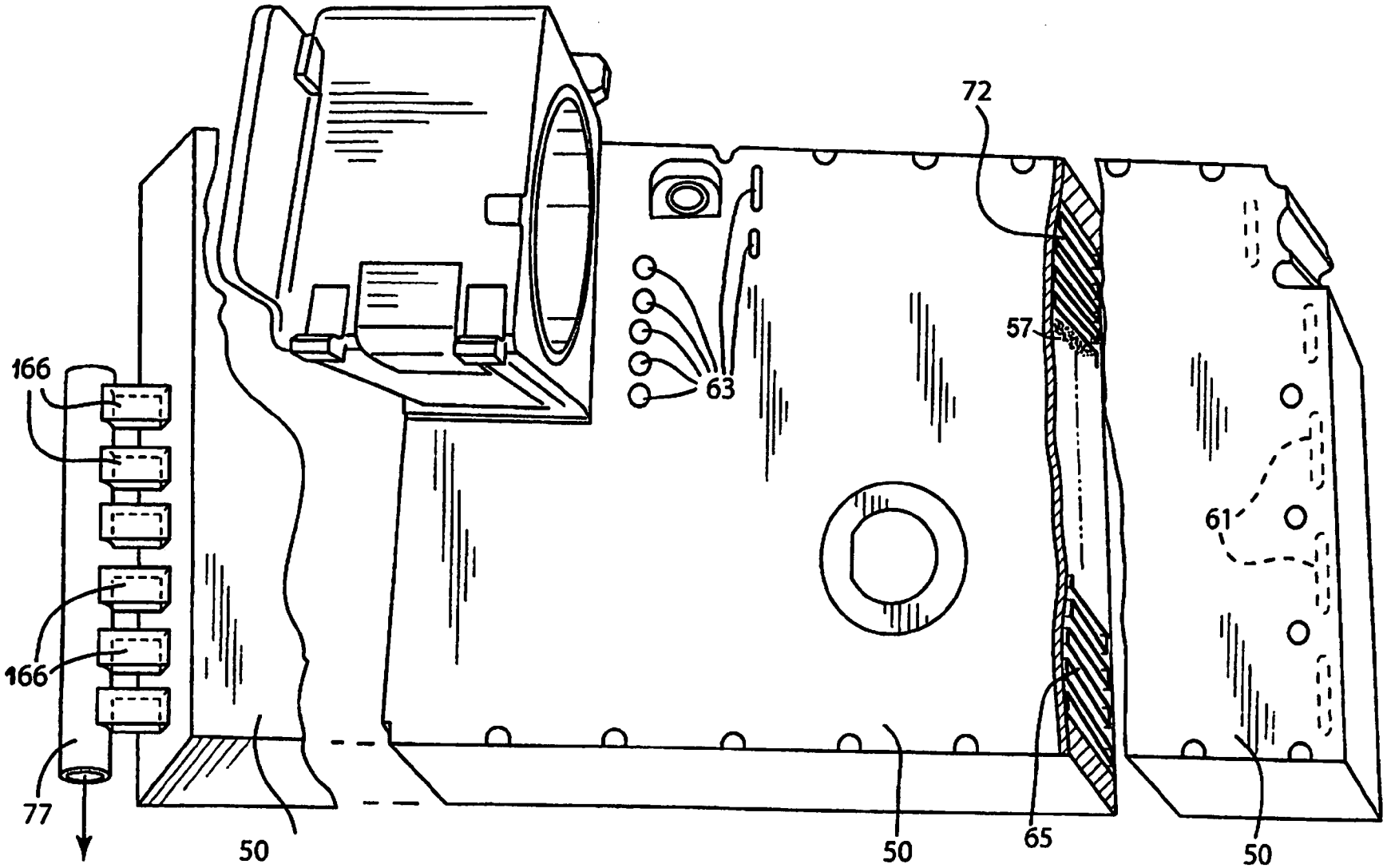
FIG. 15 is a schematic perspective view and cutaway showing the internal construction of the cold plate with internal passages and fins 58 on which dirt or soot 57 and contaminants accumulate and some of the apertures through which cooling air leaves the cold plate through exit apertures 63 and air outlet slots 166 during normal operation.

This invention also pertains to the removal of dirt or soot 57 contaminating the internal heat transfer passages 65 of the cold plate 50 (FIG. 15) and surface 114 of the heat exchanger 106 (FIG. 19) of airborne FCR APG-68 tactical radar transmitters that have been in service and the high voltage power supplies of which are being repaired. Cooling air enters the cold plate through cooling air inlet 60 (FIG. 4) and is distributed by inlet slots 61 (FIGS. 14, 15) through the internal passages of the cold plate and exits through exit apertures 63 and slots 166, (FIG. 15).

Figure 1:
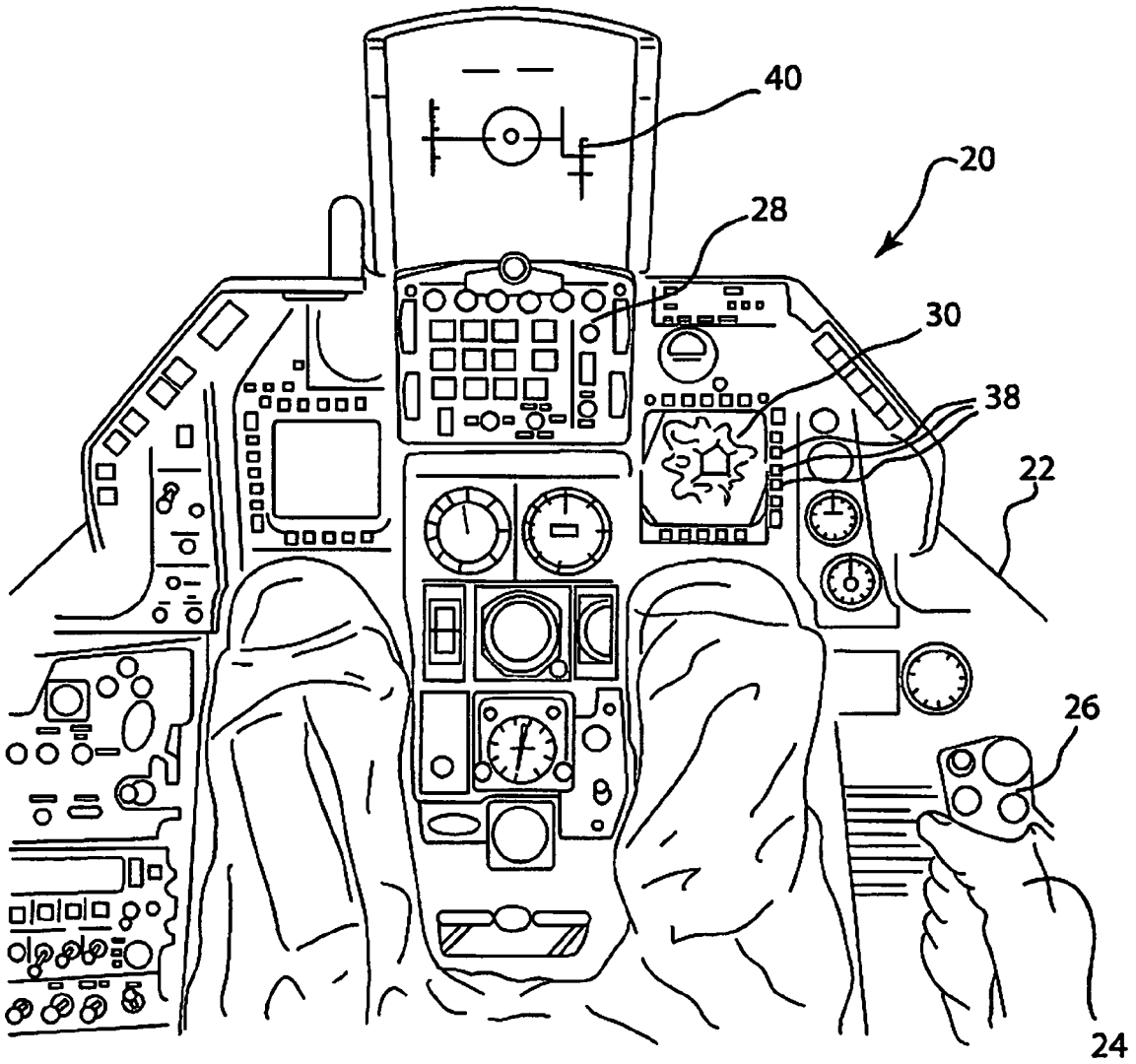
FIG. 1 ( PRIOR ART )
FIG. 1 is a front view cockpit of a state of the art military fighter aircraft having a Fire Control Radar (FCR) APG-68 display.

Referring now to FIG. 1 a cockpit 20 of a state of the art military aircraft 22 is illustrated. The cockpit includes switches and aviation instruments for controlling the flight altitude, altitude and speed of the aircraft which is controlled by the pilot 24 through a control stick 26 and rudder petals (not shown). An avionics panel 28 is provided together with a Fire Control Radar (FCR) APG-68 display screen 30.

The FCR APG-68 display screen 30 and its associated line replaceable units of a radar antenna 32 (FIG. 2) and FCR APG-68 tactical radar dual mode transmitter 34 are vital to the operation and mission of advanced fighter military aircraft. The FCR APG-68 tactical radar dual mode transmitter together with the associated common radar processor and modular receiver/exciter collectively referred to as aircraft computers (not shown) are typically located in the nose 36 of the military aircraft 22 provide vital data to FCR APG-68 display screen 30.

The vital data displayed on FCR APG-68 display screen 30 includes air, ground and sea target modes for target acquisition data and whether the target is using radar jamming techniques as well as range while searching modes, target histories, target tracking, situational awareness data as to target distances, range while searching capabilities; tracking while scanning, velocity search capabilities, air combat maneuvering capabilities, direction control of the radar, ground, air and sea target modes, ground mapping, ground moving target modes as well as additional capabilities and facilities that can be accessed through buttons 38 disposed around the perimeter of the FCR APG-68 display screen 30. In order for display screen 30 which is generally coupled to heads up display (HUD) 40 to operate properly in supplying vital data the FCR APG-68 tactical radar dual mode transmitter 34 must be providing correct and reliable data to the aircraft computers.

The FCR APG-68 tactical radar dual mode transmitter 34 is a line replaceable unit that in many instances has failed in operation. In addition the FCR APG-68 tactical radar dual mode transmitter 34 has experienced an ever decreasing mean time between failure (MTBF) after it has been repaired. Much of the FCR APG-68 tactical radar dual mode transmitter 34 (DMT) is housed in a sealed aluminum high voltage pressure vessel 42 (FIG. 3) containing high frequency electronic assemblies and high voltage power supplies. The dual mode transmitter 34 (DMT) includes protective shrouds or cover 44. The high voltage pressure vessel is sealed by bolts 46 that seal the cold plate 50 to the lower high voltage high frequency power supply housing or pressure vessel 42.

Figure 3:
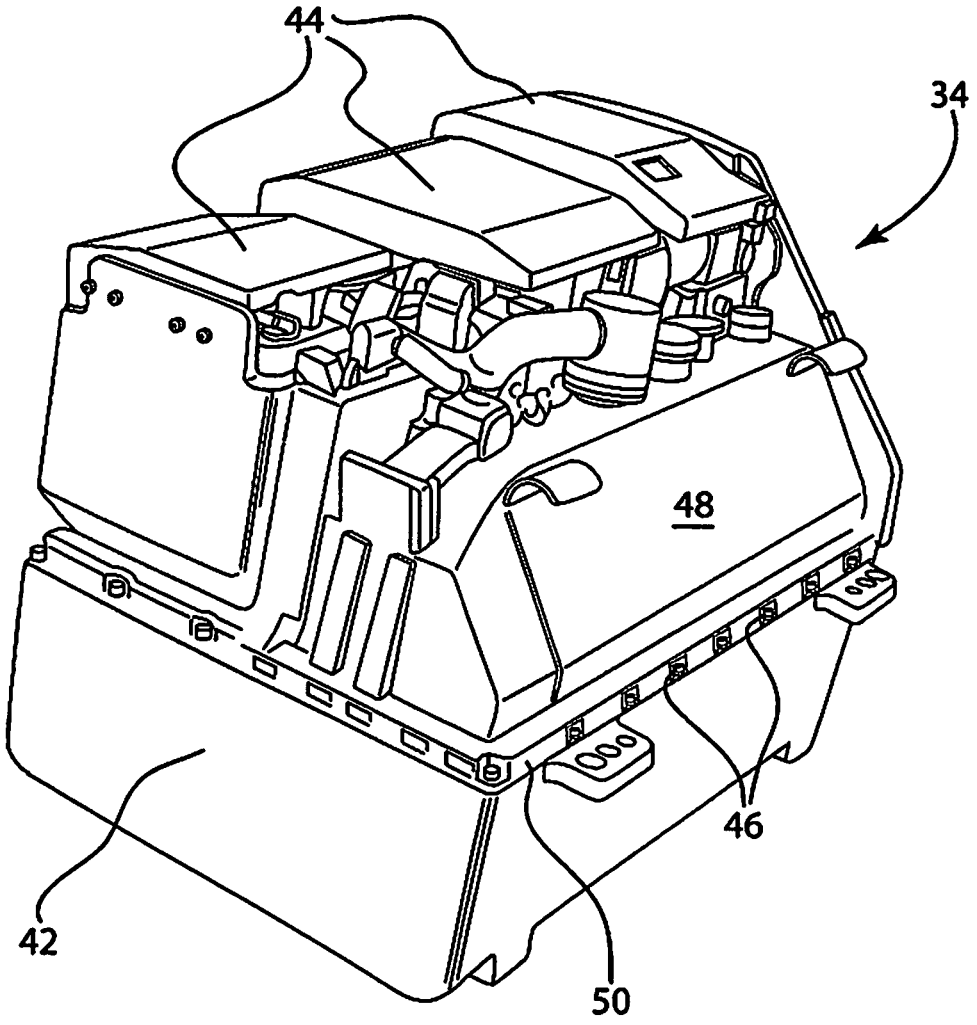
FIG. 3 ( PRIOR ART )
FIG. 3 is a perspective view of a state of the art FRC APG-68 tactical radar unit as removed from a state of the art military fighter aircraft.
Figure 4:
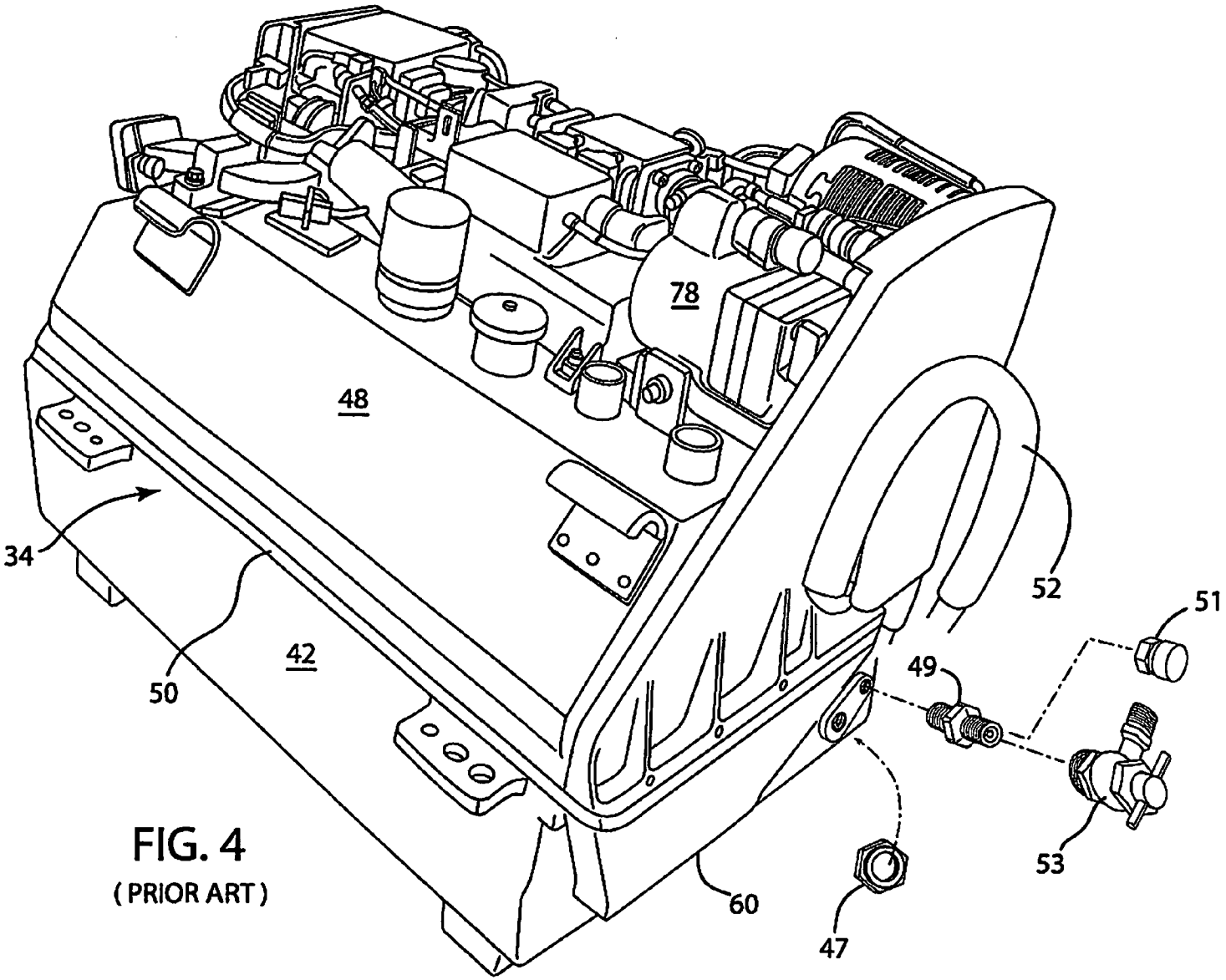
FIG. 4 (PRIOR ART)
FIG. 4 is a perspective view of the FRC APG-68 tactical radar unit of FIG. 3 with portions of the shroud removed and with the Schrader valve and pressure relief valve of the pressure vessel removed and exploded, and with an actuator used to open the Schrader valve during the final filling with $SF_6$.
Figure 5:
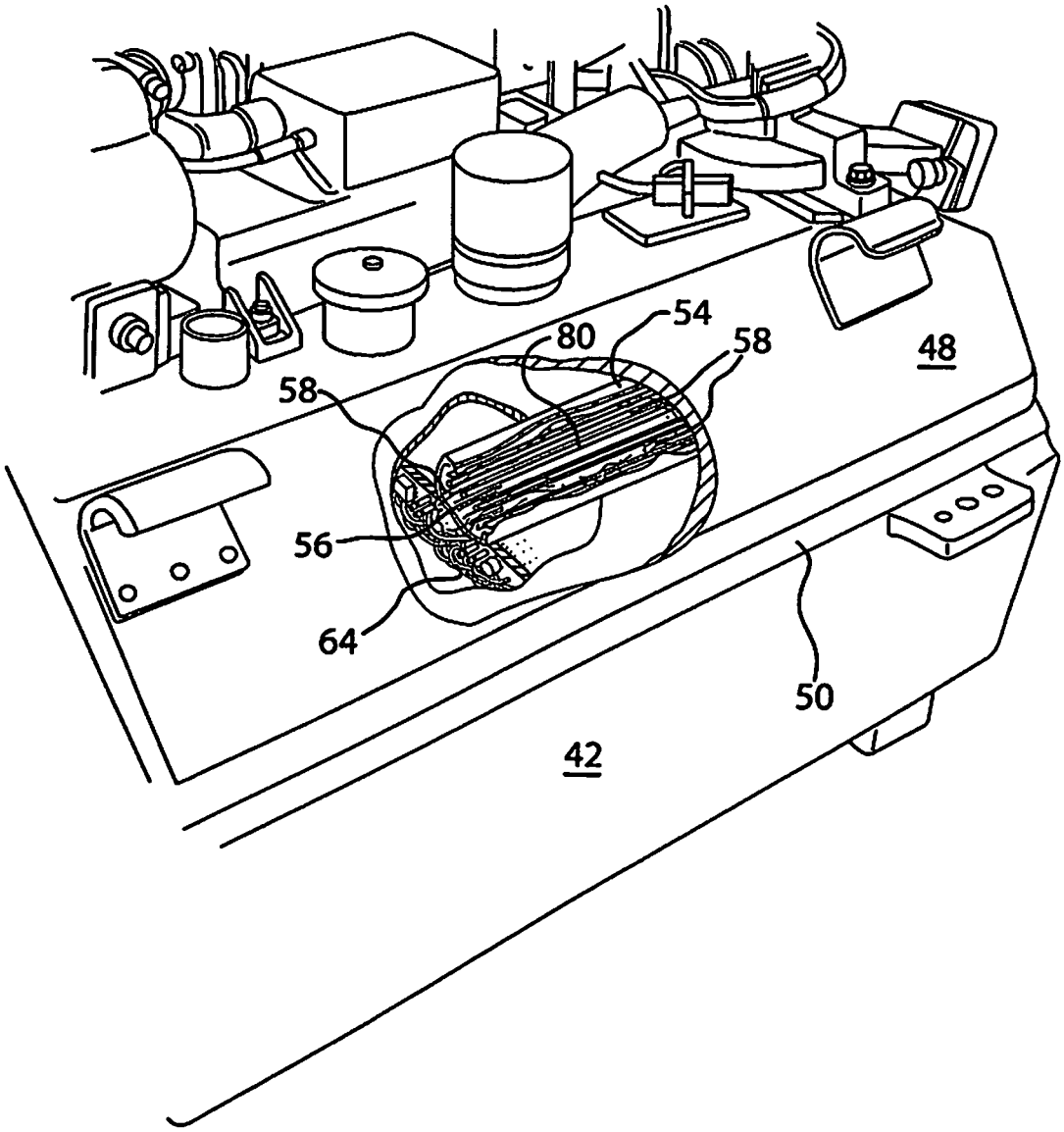
FIG. 5 ( PRIOR ART )
FIG. 5 is a perspective view of the FCR APG-68 tactical radar unit similar to FIG. 4 with a portion cut open to illustrate various components.
Figure 6:
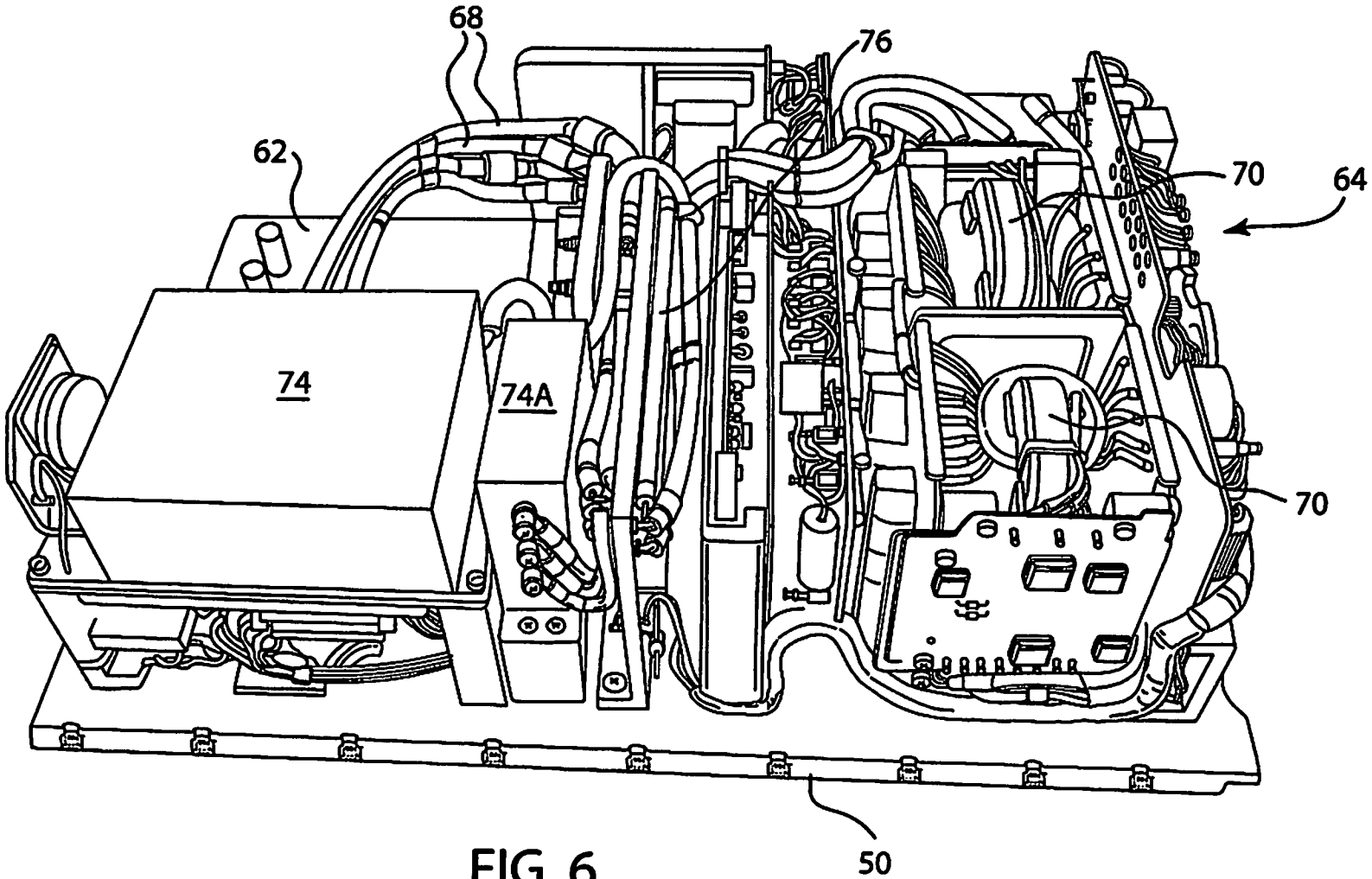
FIG. 6 (PRIOR ART)
FIG. 6 is an inverted perspective view of the cold plate of a high voltage power supply assembly removed from a FCR APG-68 tactical radar unit illustrating the heterogenous collection of mounted electronic components mounted thereon and in operation suspended therefrom.

Referring now to FIGS. 4, 5 and 6 the FRC APG-68 dual mode transmitter 34 includes a cooling hose 52 for supplying Coolanol™ 25R to a traveling wave tube (TWT) 54 (FIG. 5). Coolanol™ 25R 56 circulates around cooling fins 58 to keep TWT 54 within operating temperature parameters. A cooling unit inlet 60 (FIG. 4) is provided to cool air cooled cold plate 50 (FIG. 6). Cold plate 50 supports the high voltage high frequency power supply 64 (FIG. 6) which is supported upside down (FIG. 5) in lower high voltage high frequency power supply housing or pressure vessel 42 and sealed in an atmosphere of sulfur hexafluoride gas by an O-ring and bolts 46 (FIG. 3).

Figure 2:
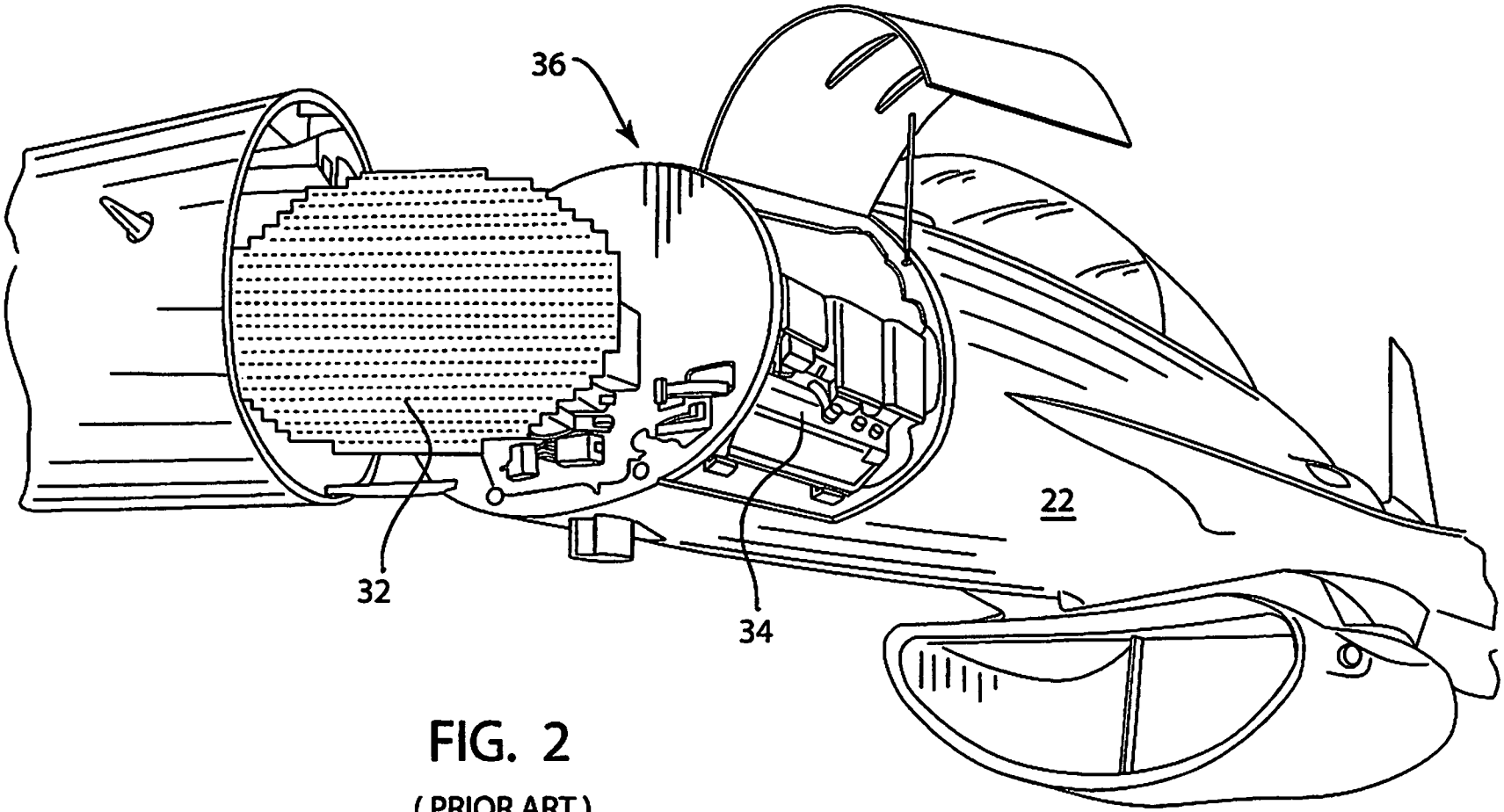
FIG. 2 (PRIOR ART)
FIG. 2 is a perspective view of a state of the art military fighter aircraft partly in section illustrating the location of the (FCR) APG-68 tactical radar unit and FCR APG-68 antenna with inertial measurement unit.

Referring now to FIGS. 2, 3 and 6 the FCR APG-68 tactical radar dual mode transmitter 34 includes the high voltage high frequency power supply 64 and accompanying high voltage wiring 68, transformers 70, voltage resistors 76 and associated electronics such as capacitors 74 and 74A that are enclosed in the pressure vessel 42. A traveling wave tube (TWT) 54, and associated cooling systems as heretofore discussed operate to remove heat from the TWT and from the associated electronics of the power supply 64. The cooling systems include the air-cooled cold plate 50 on which the electronic and power supply components are mounted (FIG. 5 and FIG. 6), an air-to-liquid heat exchanger, Coolanol™ 25R heat transfer fluid, a circulating pump 78 (FIG. 4) and the cooling fins 58 and cooling tubes 80 within the TWT 54. Air cooling inlet 60 together with cold plate 50 insure a rapid cooling of high voltage high frequency power supply 64 when military aircraft 22 goes from high temperature ground conditions resulting in a diffusion of the embedded and absorbed moisture to high altitude low temperature flight conditions causing rapid condensation of diffused embedded moisture and absorbed moisture in the high frequency power supply 64 resulting in condensation of the formerly embedded and absorbed moisture and arcing, partial discharges and failure of the FCR APG-68 tactical radar unit.

The rated power input to the TWT is 2370 watts at a duty cycle of 42%, and this is in addition to filament, grid and ion pump power. A circulating pump circulates the Coolanol™ at the rate of 2 gallons per minute through the heat exchanger, the TWT and associated tubing. The Coolanol™ serves as both a medium for heat transfer and as a dielectric insulating fluid, being subjected to a dielectric stress of 25,000 volts. A spring-loaded accumulator maintains its pressure positive at about 7 psig at the entrance to the pump through changes in temperature and altitude. The performance of the radar system is critically dependent upon the removal of heat and upon the surfaces of the TWT not being allowed to exceed 160° C. Hot spots would cause degradation of the heat transfer fluid, resulting eventually to the buildup of solids, sludge and the reduction in both heat transfer coefficients on the surfaces of the TWT and in the rate of circulation of the fluid, and failure of the radar system. Such failures do occur. A failure of one of the various components of the electronic system can cause such failures.

However a previously unrecognized cause of the failure of the cooling system is malfunction of the high voltage high frequency power supply 64 sealed in the pressure vessel 42 due to an accumulation of moisture in one or more of the components of the high voltage high frequency power supply. Band edge oscillations, RF drive-induced oscillations, noise, and waveform distortion can all result from malfunctions in the electronic components in the pressure vessel.

Moisture in the high voltage high frequency power supply 64 comes from the time of original manufacture as well as moisture absorbed by the electric components from the atmospheres of the shops in which transmitters which have failed in service are repaired. Repair involves opening up the pressure vessel in which the components of the high voltage electronic section remain sealed while in service and when repaired are generally exposed to shop atmosphere for periods of time, usually in terms of days. The service life of a FCR APG-68 tactical radar transmitter is measured in decades while in practice it is repaired over and over again. Conventional systems for drying the high voltage components of such FRC APG-68 tactical radar transmitters employ evacuation through the relatively tiny passages in the Schrader valve in the pressure vessel which is subsequently backfilled with sulfur hexafluoride. The procedure has resulted in the accumulation of moisture over multiple cycles of repair and service that has become embedded in the high voltage high frequency power supply only to be released in the pressure vessel and the $SF_6$ ambient gas by high ground temperatures followed by rapid changes in temperature encountered in flight operations.

Figure 19:
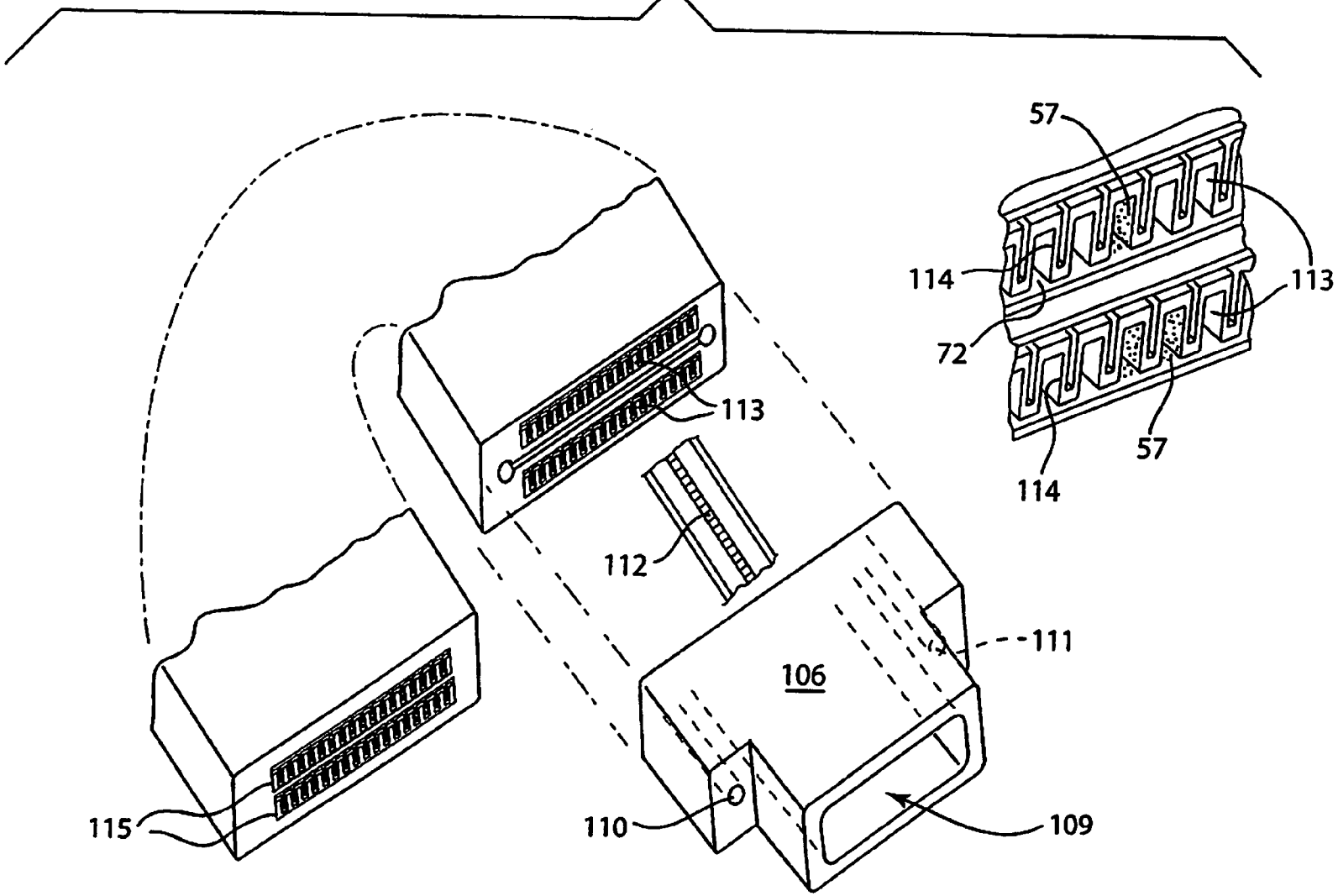
FIG. 19 is a perspective exploded cutaway view of a heat exchanger through which air flows to cool Coolanol™ which in turn cools the TWT of an FCR APG-68 tactical radar unit. Air passage surfaces 113 in contact with air become contaminated with dirt and until cleaned reduce the cooling efficiency of the heat exchanger.

It has been recently discovered that in addition to moisture, contaminants on the heat transfer surfaces of cold plates and heat exchangers of airborne FCR APG tactical radar transmitters can also result in hot spots and degradation of radar units that have been in service. Many of the FCR APG-68 units have been in service for a total of thousands of hours. Much of this time has been spent on runways in dusty locations and under operational conditions that are conducive to an accumulation of films of soot from spent hydrocarbons from spent hydrocarbons from jet fuel which can also serve as substrates for dust, insects and other debris. Contaminated and dust-laden air has been drawn through the heat transfer passages 65 (FIG. 15) of the cold plate and of the heat exchanger 106 (FIG. 19) used to cool the Coolanol™. This dirty air has contaminated the heat transfer surfaces 72 & 114 (FIGS. 15 and 19). Contaminants such as dust or soot 57 have become lodged on the internal heat transfer surfaces, resulting in the eventual buildup of solids on the air-contacting surfaces and of sludge on the Coolanol™ contacting surfaces, and reduction in heat transfer coefficients. The reduction in heat transfer coefficients results in a rise in operating temperature and a resulting decrease in mean time before failure (MTBF) of transmitters as they accumulate hours of flight service.

In one embodiment of the invention the method of increasing the operational life of an FCR APG-68 tactical radar unit involves a vigorous or through cleaning of the internal heat transfer passages of the cold plate and/or the heat exchanger. The cleaning of the internal heat transfer passages of the cold plate and/or the heat exchanger can be accomplished either before or after a step of removing moisture from the FCR APG-68 tactical radar unit. The process step of a through cleaning of the internal heat transfer surfaces of the cold plate and/or heat exchanger may also be conveniently accomplished in an evacuation chamber where a frothy cleaning fluid is introduced into the internal heat transfer surfaces.

In a further embodiment of the invention a FCR APG-68 tactical radar unit, prior to complete disassembly for repairs and while the electronic components are still sealed inside the pressure vessel 42, is subjected to a cleaning operation in which the heat transfer surfaces of the cold plate 50 are cleaned by pulling a cleaning fluid in through its inlet slots 61 while a negative pressure is maintained throughout the air passages of the cold plate by suction applied at outlet apertures or slots 166 (FIG. 15). Because of the negative pressure the cleaning solution does not escape through the apertures 63 on the top of the cold plate thereby allowing a wide variety of cleaning solvents or solutions to be utilized.

The removal of both moisture from the internal components of the FCR APG tactical radar units, as well as removal of dust and debris from the internal heat transfer surfaces of the cold plate increase the MTBF of the FCR APG tactical radar unit. Conveniently, both processes can be accomplished at the time a radar unit is disassembled and repaired. The contaminants in the internal heat transfer surfaces can be accomplished by disassembling a FCR APG-68 tactical radar unit and making repairs as may be needed and then in the preferred embodiment cleaning the internal heat transfer surfaces of the cold plate by spraying or forcing a suitable cleaning solution into ports or inlet slots 61 (FIGS. 14, 15, and 16) to remove debris and soot 57 from the internal heat transfer surfaces 72 of the cold plate 50. This may be conveniently accomplished with a variety of cleaning solutions including water based solutions with cleaning agents but preferably non aqueous cleaning solutions for cleaning electronic components particularly where the electronic components have not been completely removed from the cold plate to avoid deleterious contact with the electronic components and the subsequent longer and more expensive removal of moisture process in accordance with the invention.

Figure 16:
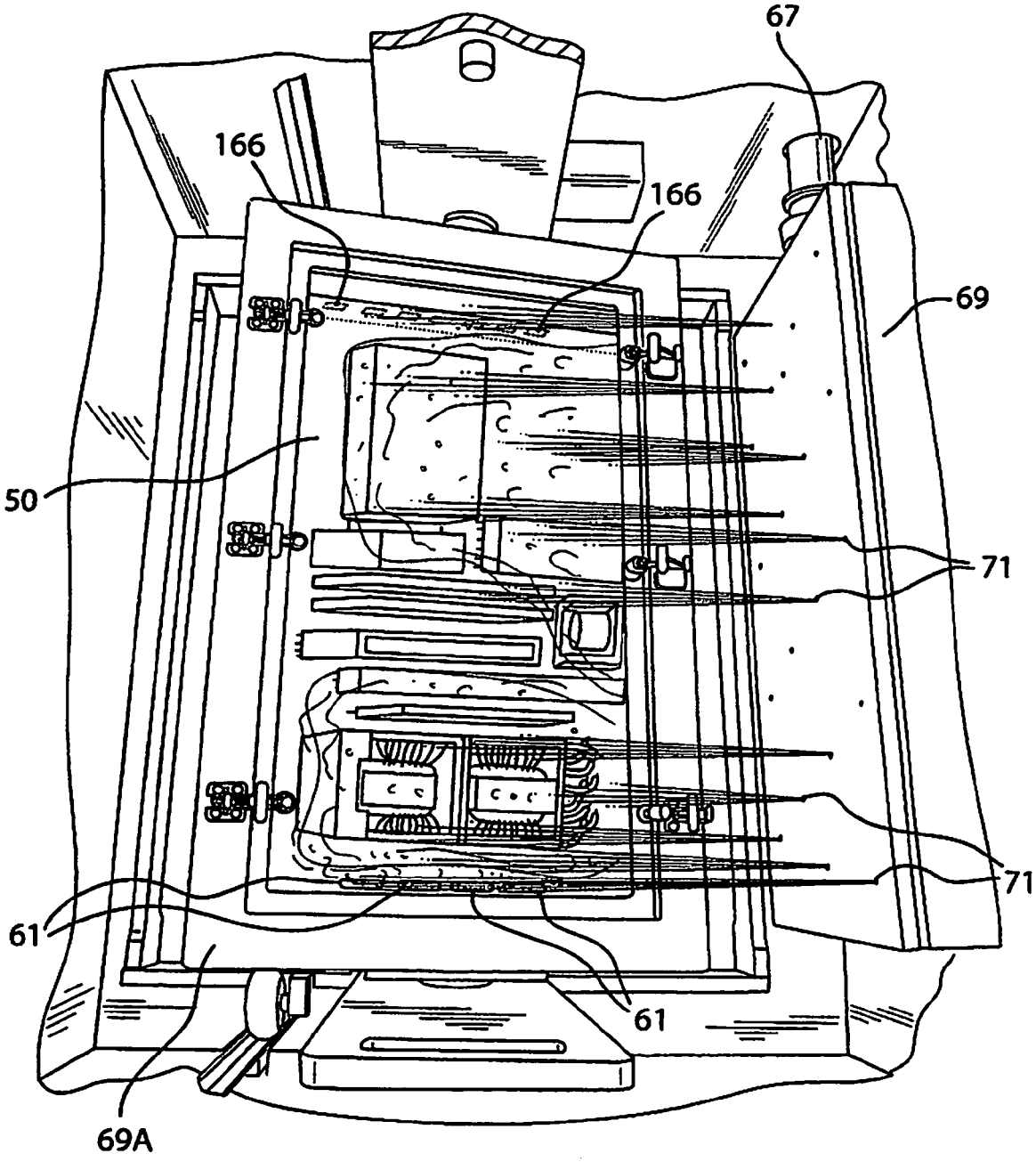
FIG. 16 is a top plan cut away view of a cleaning chamber having a FCR APG-68 tactical radar rotatable support and high pressure cleaning ports.

Referring now to FIG. 16 and in accordance with the preferred embodiment of the method of cleaning the internal heat transfer surfaces of the cold plate utilizes a solution of Fluorinert™. The solution can be sprayed into a chamber 69 containing the cold plate 50 mounted on a rotatable frame 69A. A manifold in chamber 69 is employed to feed a cleaning solution preferably of Fluorinert™ under pressure through inlet feed pipe 67 to multiple manifold jets 71. The manifold jets preferably surround the rotatable frame 69A which for purposes of simplicity have been illustrated with only one manifold. The Fluorinert™ or other fluid sprayed preferably under pressure rinses out the electronic components and enters apertures or slots 61 and flows through and cleans the internal passages or surface 72 (FIG. 15) of the cold plate and flows out apertures 63 (FIG. 15) and out the slots 166 in the cold plate.

Figure 17:
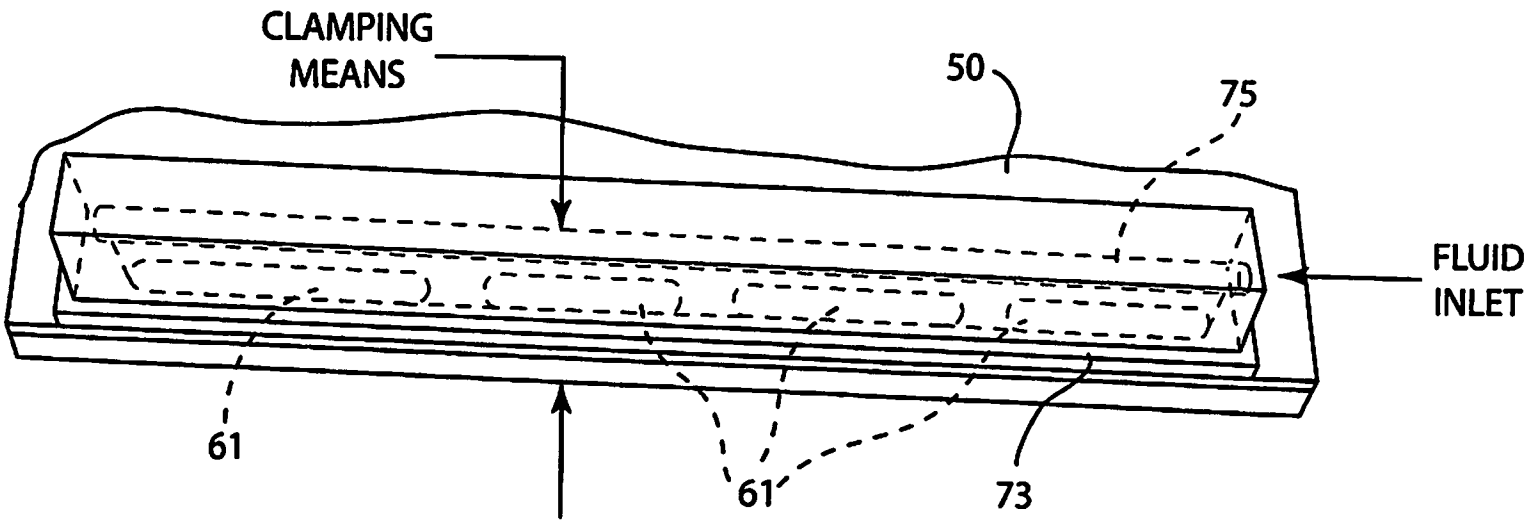
FIG. 17 is a perspective view of a portion of the end plate of a cold-plate illustrating one embodiment of the invention for forcing a cleaning fluid through a cold plate.

In a further embodiment of the invention a dielectric cleaning fluid, such as Fluorinert™, is pumped through the end of the cold plate 50. In this embodiment of the invention cold plate 50 is clamped and sealed by an elastomeric gasket 73 (FIG. 17). The cleaning fluid is forced through inlet 75 into slots 61 of cold plate 50 to flush out debris and soot 57 in the internal heat transfer surfaces of the cold plate. The flow of dielectric fluid should be at a rate of 4 to 25 gallons per minute and preferably 15 gallons per minute. Similarly a dielectric fluid can be pumped through air passages 112 (FIG. 19) of heat exchanger 106, although since contact with electronic components would not be involved, use of a more aggressive cleaning fluid is preferred.

In a further application of the invention a FCR APG-68 tactical radar unit is disassembled, and after making desired repairs it is tested for corona discharge in a bath of dielectric fluid such as Fluorinert™. This bath dislodges some of the debris that has accumulated within the air-contacting heat transfer surfaces of the many cold plates that have been tested. Being of lesser density than the Fluorinert™, much of this debris floats to the surface of the bath and is deposited on the electronic components as they are withdrawn from the bath. The electronic components of the repaired power supply are subjected to impingement by jets 71 of Fluorinert™ (FIG. 16) to remove the debris just deposited as well as to remove contaminants resulting from the repair operations. Fluorinert™ from jets 71 are also directed to slots 61 (FIGS. 14, 16) to dislodge debris 57 (FIG. 15) from the air-contacting heat transfer surfaces of the cold plate. The flow of dielectric fluid should be at a rate of 5 to 50 gallons per minute and preferably 25 gallons per minute. The pressure drop across the cold plate or heat exchanger should be between 2 and 25 pounds per square inch, and preferably at least 5 pounds per square inch.

In a further embodiment of the invention a FCR APG-68 tactical radar unit is disassembled and after desired repairs have been made it is tested for corona discharge in a bath of Fluorinert™. Subsequently the electronic components of the repaired power supply are subjected to impingement by jets 71 of Fluorinert™ (FIG. 16) to remove contaminants resulting from the repair and corona testing operations. In a separate operation the heat transfer surfaces of the cold plate or of the heat exchanger are cleaned by sucking a cleaning fluid through slots 61 (FIGS. 14, 15, 18 and 19) of the cold plate or the air inlet 109 (FIGS. 18 and 19) of the heat exchanger 106 while a negative pressure is maintained throughout the air passages of the unit being cleaned. In this suction implementation of the invention the use of fluid such as an aqueous solution is permissible because this negative pressure prevents the cleaning fluid from coming into contact with the electronic components. In the preferred embodiment of the invention a hydroscopic or an electronic compatible solution such as Fluorinert™ is preferred as cleaning solutions due to the deleterious effect of water on electronic components.

Figure 18:
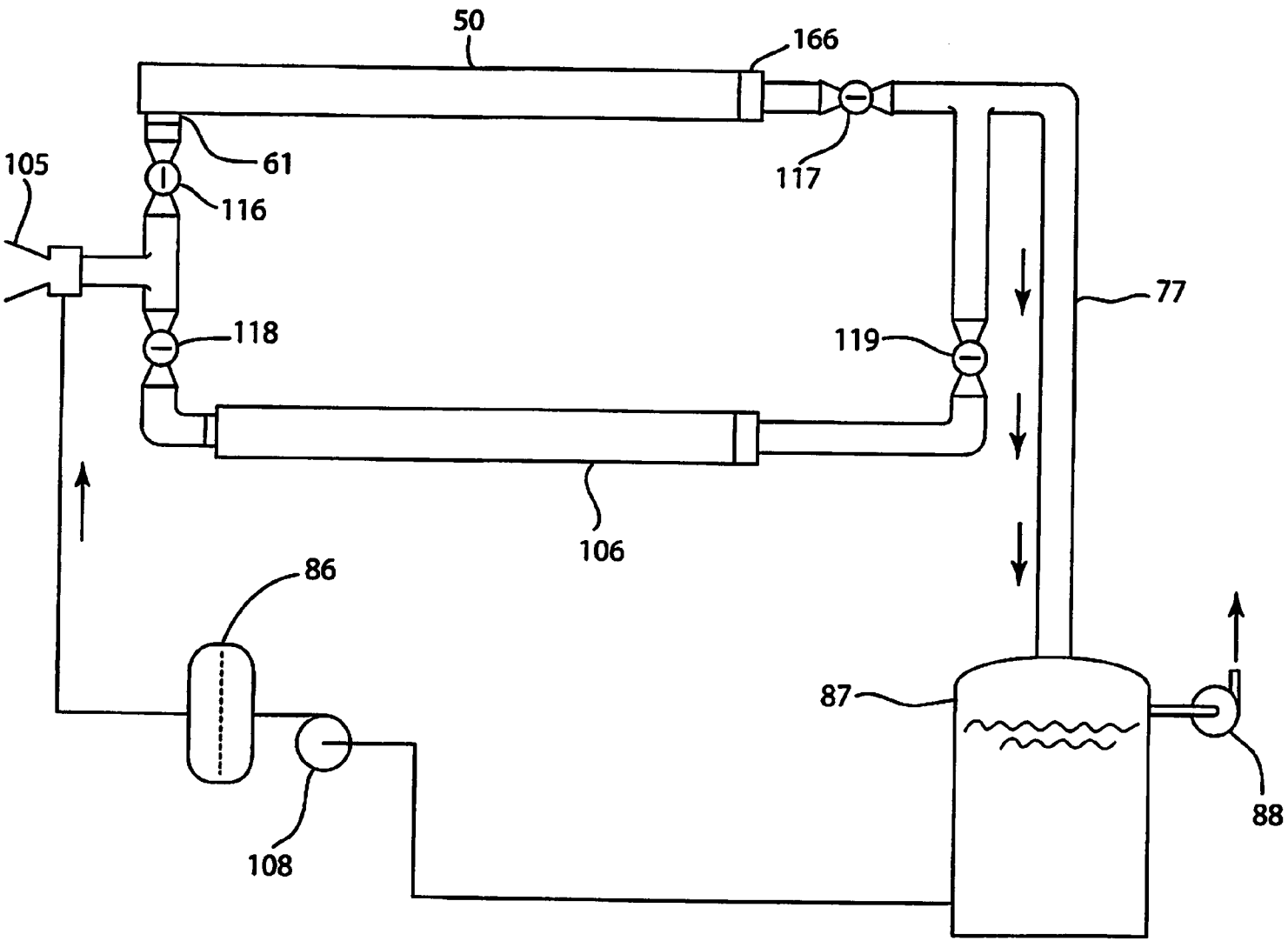
FIG. 18 is a diagrammatic view of a further embodiment of the invention illustrating the cleaning of a cold plate and heat exchanger by suction and/or pressure assisted circulation of aggressive cleaning fluids.

The cleaning apparatus illustrated in FIG. 18 is provided with valves 116, 117, 118 and 119 to alternatively provide for cleaning of either the cold plate 50 or the heat exchanger 106. Other cleaning apparatus can be designed for the separate cleaning of the cold plate 50 and the heat exchanger 106. In the preferred embodiment a single apparatus can be employed to clean both the cold plate 50 and the heat exchanger 106 by alternatively opening valves 116 and 117 and closing valves 118 and 119 to alternatively clean cold plate 50 and heat exchanger 106.

In cleaning cold plate 50 with the apparatus illustrated in FIG. 18 valves 116 and 117 are opened while valves 118 and 119 are closed and the cleaning fluid 107 after being pumped through filter 86 is mixed with air and sucked into the cold plate through slots 61 of the cold plate or the air inlet 109 of the heat exchanger 106. The aerated cleaning fluid leaves the cold plate through slots 166 (FIG. 15) and suction line 77 (FIG. 15) of the cold plate or the air outlets 115 (FIG. 19) of the heat exchanger and is transferred back to separator 87 where cleaning fluid 107 is separated from the air in separator 87. The air is withdrawn by a suction blower 88 (FIG. 18) that maintains a negative pressure in the separator 87 between 5 and 90 inches of water and preferably at least 50 inches of water. The suction blower 88 should be capable of handling from 5 to 30 and preferably about 25 standard cubic feet of air per minute at its operating inlet pressure. Cleaning solution is pumped at a rate of 0.5 to 5 and preferably about 1 gallon per minute into the liquid-air mixer 105.

Alternatively when cleaning the heat exchanger 106, valves 116 and 117 are closed and valves 118 and 119 are opened to allow the same apparatus to alternatively clean the heat exchanger 106. In both cleaning operations the cleaning fluid is preferably pumped in by circulating pump 108 and forced through filter 86 before being mixed with air in the liquid-air mixer 105.

It is generally preferable to thoroughly clean the internal heat transfer surfaces of the cold plate before removing moisture and other contaminants from the electronic components of the FCR-APG tactical radar units. Depending upon the type of repairs contemplated all or a portion of the electronic components can be removed from the cold plate. In each case the amount of electronic components removed from the cold plate as well as the overall condition of the cold plate will dictate to those skilled in the art the degree of cleaning required of the mechanical portion of the FCR APG tactical unit before removing moisture from the electronic portion of the FCR APG tactical radar unit. In some cases cleaning of the mechanical components may not be necessary as where a new or reconditioned cold plate mechanical component is utilized. In all such cases after cleaning removal of moisture from the electronic components is appropriate in accordance with the invention.

Referring now to FIGS. 18 and 19 the cleaning fluid, after being pumped through filter 86 is mixed with air and sucked into the heat exchanger 106 through the air outlet 111, passes through the air passages 113 under highly turbulent conditions and leaves the heat exchanger 106 through the air inlet 109 and suction line 77 (FIGS. 15 and 18). Thereafter cleaning fluid is separated from the air in separator 87. The air portion of the cleaning fluid 107 is withdrawn by a suction blower 88 (FIG. 18) that maintains a negative pressure in the separator 87 between 5 and 90 inches of water and preferably at least 50 inches of water. The suction blower should be capable of handling from 5 to 30 and preferably about 25 standard cubic feet of air per minute at its operating inlet pressure. Cleaning solution is pumped at a rate of 0.5 to 5 and preferably about 1 gallon per minute into the liquid-air mixer 105. When cleaning a heat exchanger 106, valves 118 and 119 are open and valves 116 and 117 are closed. The cleaning fluid is preferably pumped in by circulating pump 108 and forced through filter 86 before being mixed with air in the liquid-air mixer 105.

The invention provides a method for removing embedded moisture over multiple cycles of repair as well as absorbed moisture which is acquired whenever the high voltage high frequency power supply is opened up or repaired. The invention in its best mode and preferred embodiments for repeatedly repaired units or units that have been repaired or reconstructed with components that are known to adsorb or absorb moisture includes the following steps:

(a) After disassembling a FCR APG-68 tactical radar unit repairing, reassembling, testing and optionally cleaning it in accordance with the invention the high voltage high frequency power supply is placed in a vacuum chamber or placed in a high voltage high frequency power supply from a FCR APG-68 tactical radar unit in a vacuum chamber whose walls are heated and controlled at temperatures in the range of 45 to 105° C., preferably at 70 to 85° C., which vacuum chamber has a circulating fan and with a sliding shelf and loading door at one end;

(b) Employing a vacuum pumping system capable of reducing the partial pressure of permanent gases in the vacuum chamber below 10 Torr and preferably below 100 milliTorr;

(c) Utilizing a cold trap operated at or below 0° C. and preferably at or below minus 70° C. between the vacuum pumping system and the vacuum chamber;

(d) Removing moisture from the high voltage high frequency power supply until the rate of moisture desorption has fallen to below about 2 mg/minute at about 60° C. or 5 mg/minute at about 70° C. or 25 mg/minute at 85° C. and preferably below 0.1 mg/minute at about 60° C. or about 0.4 mg/minute at 70° C. or about 2 mg/minute at about 85° C. or until the high voltage high frequency power supply has been in the vacuum chamber for at least 4 hours or operating the evacuation chamber until the rate of moisture removal is less than about 20 milligrams per minute at about 70° C. or for at least 2 hours;

The following steps are optional but are in accordance with the preferred embodiment and include the additional steps of:

(e) Providing a vacuum valve disposed between the cold trap and the vacuum chamber for the purpose of periodically isolating the chamber from the cold trap;

(f) Employing measurement means communicating with the atmosphere within the vacuum chamber, consisting as a minimum of a pressure gauge such as a thermocouple gauge capable of indicating pressures down to 1 milliTorr, and preferably including moisture instrumentation capable of displaying dew point down to −70° C. or moisture concentration in parts per million;

(g) Utilizing temperature measurement means that can be clamped to a massive portion of the electronic assembly for the purpose of indicating the temperature of that assembly;

(h) Removing the high voltage high frequency power supply while still warm at 35 to 40 degrees C. and either sealing the high voltage high frequency power supply in a gas impervious package and evacuating the package or reassembling the high voltage high frequency power supply in the sealed high pressure vessel and backfilling the sealed high pressure vessel with a dry gas within preferably 5 minutes to about 2 hours after it has been processed in the vacuum chamber;

(i) Backfilling the vacuum chamber with a dry substantially inert gas having a dew point below 5° C. such as nitrogen or carbon dioxide or an inert gas such as helium, argon or neon while the high voltage high frequency power supply is being dried;

(j) Employing a temperature of about 80° C. for removing embedded moisture from a high voltage high frequency power supply that has been previously repaired but not treated in accordance with the method of the invention;

(k) Evacuating through the cold trap;

(l) Closing a valve between the cold trap and vacuum chamber and observing the rate at which the pressure in the chamber or moisture concentration builds up over a period of one minute and recording the pressure or moisture concentration; and (m) In the preferred embodiment and best mode providing a space between the cold plate of the high voltage high frequency power supply and the upper edge of the pressure vessel all around the periphery of the cold plate to provide a path of high conductance between the interior of the pressure vessel and the surfaces of the high voltage high frequency power supply.

The method of the invention also encompasses drying a high voltage high frequency power supply that has just been repaired and cleaned by utilizing the steps of:

(1) In the preferred embodiment and best mode providing a space all around of at least one-half inch between the cold plate of the high voltage high frequency power supply and the pressure vessel with its O-ring seal in place below and mounting the two parts of the repaired transmitter assembly on a sliding shelf of the pressure chamber;

(2) Using a sliding shelf in the pressure chamber and pushing the sliding shelf with the cold plate assembly and pressure vessel into the chamber, closing and sealing the door;

(3) Preferably evacuating the chamber to a pressure below 10 Torr and preferably below 1 Torr;

(4) Preferably backfilling the chamber with an inert dry gas, normally nitrogen, but equally effective, although more expensive such gases as helium, argon, neon, and carbon dioxide or air whose dew point is below 5° C.;

(5) Starting a circulating fan to accelerate the heating of the assembly;

(6) Stopping the circulating fan as the temperature of the load approaches the chosen temperature (normally 70° C. after a single repair).

(6a) A temperature of 75° or 80° C. is normally employed when removing moisture from a high voltage high frequency power supply that has been in service for years without benefit of this drying treatment after each servicing; (Temperatures as low as 40° C. can be employed, but such low temperatures result in inconveniently long drying times.) Temperatures up to 105° C. may be employed but run the risk of damaging electronic components and overdrying insulation;

(7) Evacuating the chamber through the cold trap;

(8) Preferably periodically closing the valve between the cold trap and the vacuum chamber and observing the rate at which the pressure in the chamber or the moisture concentration within the chamber rises over a period of approximately one minute by recording the pressure or the moisture concentration at the beginning and end of a one minute period;

(9) Preferably converting the pressure rise or the concentration of moisture rise over a one minute period to a moisture desorption rate;

(10) Terminating the drying after a period of time sufficient to cause the rate at which moisture is being desorbed from the high voltage high frequency power supply of a unit which has had the embedded moisture previously removed to drop to a rate of 5 mg per minute and preferably 0.4 mg per minute but not as low as 0.1 mg/minute at about 85° C. to 0.2 mg/minute at 70° C.;

(11) Backfilling the chamber with a dry inert gas, preferably nitrogen, but equally effective, although more expensive, such gases as helium, argon, neon, and carbon dioxide or air whose dew point is below 5° C.;

(12) Opening the door of the chamber but allowing the flow of dry inert gas to continue, blanketing the load, withdrawing the high voltage high frequency power supply and the pressure vessel at least partially from the chamber by pulling the sliding shelf forward out of the chamber while the high voltage high frequency power supply is still warm and preferably above 50° C.;

(13) Lowering the cold plate bearing its electronics and high voltage power supply down into the lower high voltage high frequency power supply housing or pressure vessel 42 so that its electronic and power supply assemblies project down into the pressure vessel and its sealing surface seals to the O-ring of the pressure vessel while the load is still at a temperature above 40° C. and preferably above 50° C. (This assures that the atmosphere within the pressure vessel at this point in time is at a very low relative humidity); and

(14) Evacuating the pressure vessel through its Schrader valve and backfilling it with sulfur hexafluoride.

It has been recently found the process of the invention is applicable to newly manufactured units as well as newly assembled units that have not accumulated moisture in their components as a result of repeated repairs or exposure of their components to ambient atmospheres containing high levels of moisture. In such cases moisture which has not become embedded or adsorbed in such units can be removed by removing either the Schrader valve or the pressure relief valve and preferably both from the assembled radar transmitter unit and sealing the cold plate 50 (FIG. 6) to the pressure vessel 42 (FIG. 3) by placing the O-ring in place and securing the cold plate and pressure vessel together with bolts 46 (FIG. 3) in accordance with the prior art procedures and methods. Optionally the other components of the high voltage high frequency power supply may also be assembled and attached to the cold plate such as the TWT, heat exchanger, hoses 52 (FIG. 4) circulating pump 78 (FIG. 4) and covers 44 and 48 (FIG. 3). Thereafter the following steps are utilized:

(1) Removing the pressure relief valve 47 from the pressure relief port (FIG. 4) and the Schrader valve 49 with its cap 51 (FIG. 4) from the fill port at the end of the pressure vessel 42, thus exposing orifices of approximately 5/16" and 1/4", respectively; (These orifices or ports provide sufficient conductance between the interior of the pressure vessel and the chamber to permit non-embedded moisture to be removed in about 2 hours to 24 hours and preferably three to four hours at a temperature of about 40° C. to 100° C. and preferably 75° C.);

(2) Placing the assembly on the sliding shelf, pushing the entire unit into the chamber at a preferred temperature of 70° C. to 85° C., closing and sealing the door;

(3) Operating the circulating fan until the temperature of DMT or unit reaches about 5° C. of the target temperature of 70° C. to 85° C., then stopping the fan and starting to evacuate the chamber through a cold trap maintained below −65° C.;

(4) After one hour of evacuation, checking to assure that the pressure in the chamber is below 750 milliTorr or within 10% of the target pressure. (A pressure greater than 750 milliTorr is an indication of malfunction of the equipment or gross leakage);

(5) After three to four hours of evacuation, backfilling the chamber with dry nitrogen gas;

(6) Opening the door of the chamber and pulling the sliding shelf out of the chamber;

(7) Reinserting immediately the pressure relief valve 47 (FIG. 4) and the Schrader valve 49 (FIG. 4) into the orifices from which they had been removed and screwing them in with the proper torques (At this point the high voltage high frequency power supply may optionally be removed from the sliding shelf and positioned on an adjacent supporting surface);

(8) Applying a valve actuator 53 such as a Schrader valve-actuator (FIG. 4) to a valve 49 such as a Schrader valve, employing the valve-actuator to open the Schrader valve and evacuating the interior of the pressure vessel through the Schrader valve;

(9) After thirty minutes of evacuation, closing a valve in the evacuation line, then observing and noting the pressure between that valve and the Schrader valve;

(10) Observing the pressure again after two minutes. If the pressure in an assembly that has not previously been processed to remove embedded moisture has risen more than 100 milliTorr with respect to the pressure observed two minutes previously, the assembly should be rejected and subjected to a rigorous leak testing procedure, preferably involving a helium mass spectroscopic leak tester (Testing the pressure vessel for leakage with a helium leak tester while the pressure vessel is still under vacuum and before it is filled with sulfur hexafluoride is highly desirable even when the pressure rise observed in step number 10 above does not exceed 100 milliTorr);

(11) Backfilling the pressure vessel through the Schrader valve with sulfur hexafluoride, closing the Schrader valve with the Schrader valve actuator, removing the valve actuator and applying cap 51 (FIG. 4).

Not all of the foregoing steps and not necessarily in the order presented are necessary to implement the invention. The foregoing list of steps and their order are provided merely for the purposes of illustration and are not to be considered limiting unless limited in the claims.

Figure 13:
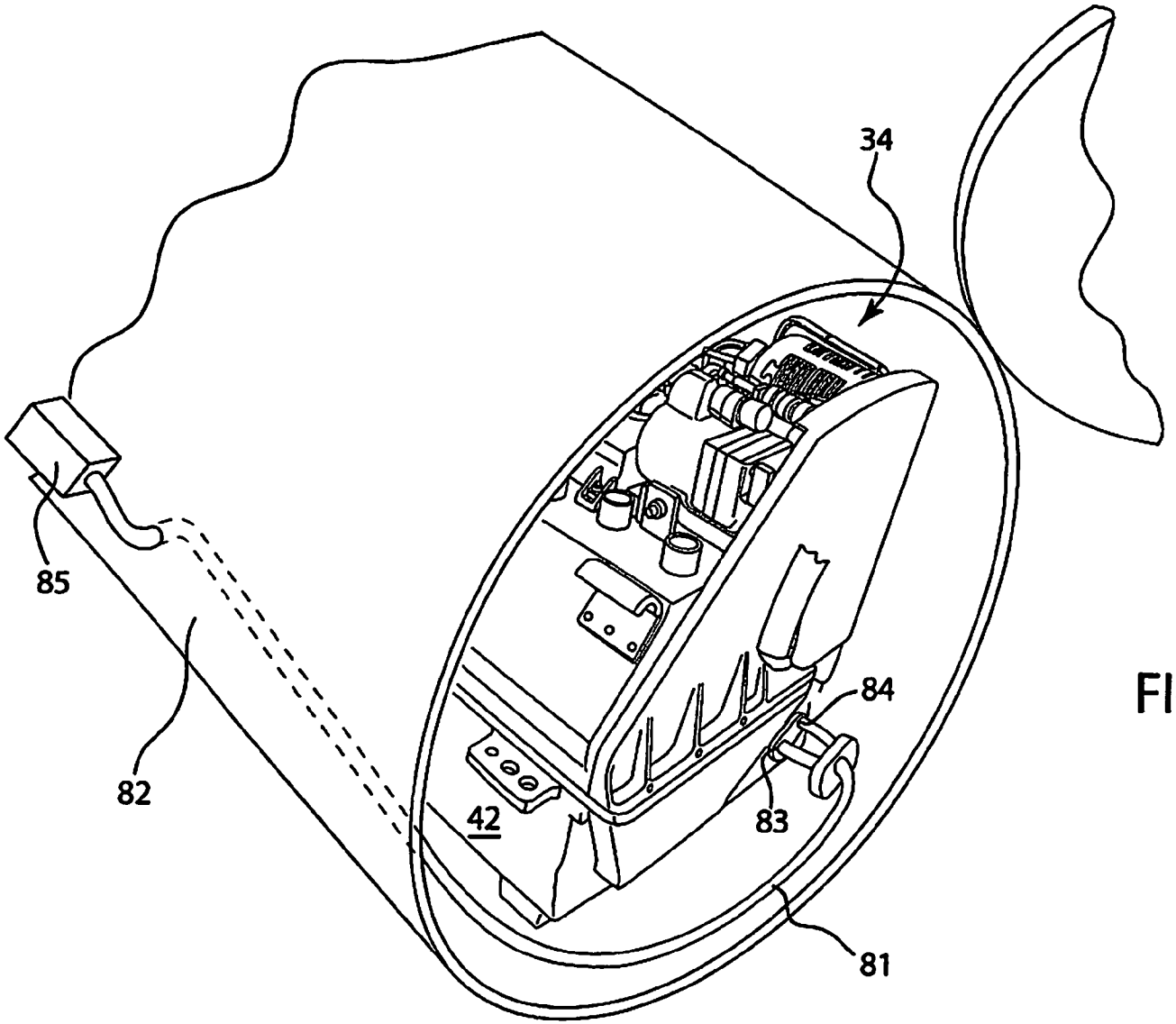
FIG. 13 is a perspective view of a heating oven or chamber containing a newly manufactured or repaired FCR APG-68 tactical radar unit with vacuum lines for removing moisture attached to the ports normally occupied by a Schrader valve (FIG. 4, 49) and a pressure relief valve (FIG. 4, 47) in accordance with an alternative embodiment of the novel method.

In a further alternative embodiment new units or units that have been recently treated to remove embedded moisture may be treated in a conventional heating oven. Referring now to FIG. 13 a conventional heating oven 82 is illustrated containing a new or recently treated dual mode transmitter 34. Dual mode transmitter 34 has had the pressure relief valve 47 (FIG. 4) removed from the pressure relief port 83 as well as a pneumatic valve such as a Schrader valve 49 removed from the fill port 84;

A vacuum line 81 is run from a vacuum pump or source 85 and connected to the pressure relief port 83 or the fill valve port 84 and preferably both as illustrated in FIG. 13. The vacuum pump or source 85 preferably includes a valve and a cold trap. The conventional heating oven 82 is then heated until the DMT or unit reaches a range of about 70° to 85° C. at which time vacuum pump or source 85 is operated at least below 10 Torr and preferably in the range of about 100 milliTorr to 750 milliTorr. The DMT 34 is then removed from the heating oven 82 and backfilled with sulfur hexafluoride.

In radar units that have been repeatedly repaired or that have had components replaced that are known to adsorb, absorb or retain moisture the preferred application of the invention involves separation of the components and desorption treatment for a period of time as previously discussed. The period of time required to cause the rate at which moisture is being desorbed from the electronic assembly to drop to a target value is preferably determined from the measurement of the pressure rise or change in moisture concentration over a period of one minute. However it will be understood that a standard period of drying time could be employed after it had been determined by measurements on a number of transmitters to be adequate at the temperature employed to cause the rate of moisture desorbing from the average load to fall to a value below that corresponding to 2 mg/minute or preferably 0.4 mg/minute at 70° C. but not as low as 0.2 mg/minute. At 70° C. the moisture content of a space is approximately 24 mg/cubic foot/Torr of vapor pressure of water and between 40° C. and 100° C. it remains 24±2 mg/cubic foot. The rate of evolution in mg/minute may be estimated from the rate of rise of pressure by multiplying the rate of rise of pressure in mTorr/minute by the volume of the chamber in cubic feet and by 0.024.

A suitable target rate for removal of embedded moisture from an FCR APG-68 tactical radar high voltage high frequency power supply at 70° C. is 0.4 mg/minute. When the rate of removal of moisture drops to this value still further drying is possible but risks the removal of excessive and undesirable quantities of plasticizers and impregnating oils.

Figure 7:
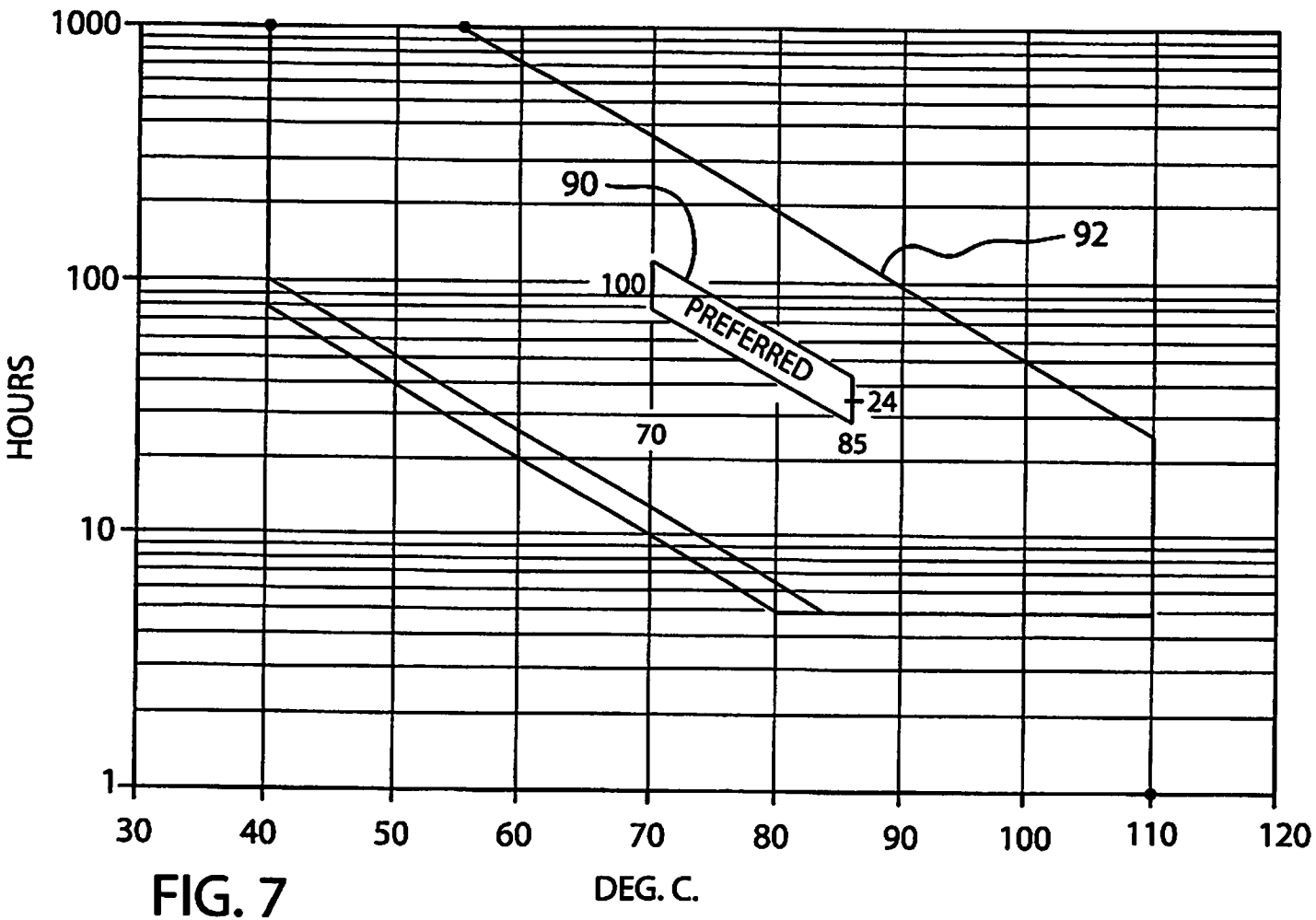
FIG. 7 is a graph illustrating the temperature and time parameters for removing deleterious embedded moisture and absorbed moisture from the heterogenous collection of electronic components of the high voltage power supply assembly of a FRC APG-68 tactical radar unit in accordance with the invention.

Referring now to FIG. 7 the preferred embodiment for drying high voltage high frequency power supply units from FCR APG-68 tactical radar dual mode transmitters is illustrated. The preferred temperature range is from about 70° C. to 85° C. for a period of from about 24 hours to about 100 hours as represented by preferred rectangular box 90 to remove embedded and absorbed moisture that is deleterious to the operational life of the FCR APG-68 tactical radar dual mode transmitters.

Line 92 (FIG. 7) represents atmospheric pressure indicating the invention may be practiced without utilizing a vacuum but at the expense of very long drying periods approaching 1,000 hours or more. Typically a vacuum of less than 0.1 Torr and preferably less than 5 Torr and in the preferred rectangular box 90 a vacuum of 100 to 200 milliTorr is utilized in accordance with the best mode and preferred embodiment of the invention.

The invention will be further described with reference to the following operative examples which are provided for the purpose of further illustrating the novel and unobvious aspects of the invention without limiting the invention except as many hereinafter be limited in the claims.

Example 1

A high voltage high frequency power supply was removed from a FCR APG-68 tactical radar dual mode transmitter from a B1 bomber state of the art transmitter. The high voltage high frequency power supply was placed in an evacuation heating oven Model No. 1061 as available from Slack Associates, Inc. and heated to a temperature of about 85° C. and evacuated to a pressure of about 150 milliTorr for almost 4 days until the amount of water removed dropped to about 1 milligram per minute. A total of about 10.39 grams of water was removed.

Figure 8:
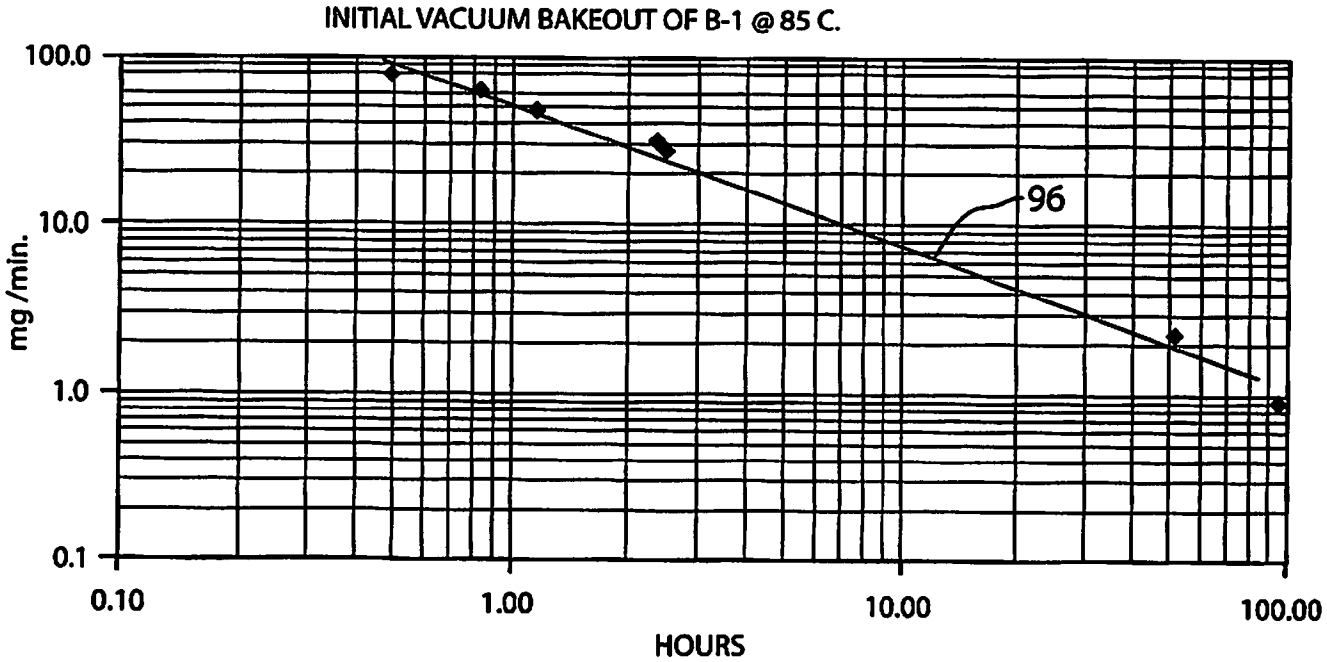
FIG. 8 is a data list and graph illustrating the rate of embedded moisture removed from a FRC APG-68 tactical radar unit removed from a high voltage high frequency power supply assembly from a B1 military bomber utilizing the method of the invention.

The data and graph illustrating the removal of moisture from the high voltage high frequency power supply from the FCR APG-68 tactical radar dual mode transmitter is illustrated in FIG. 8 illustrating an Average Rate Line 96 showing a rate of removal as a function of time on a log-log scale.

Example 2

The previously dried high voltage high frequency power supply of Example 1 was then left for about three days to ambient atmosphere. The high voltage high frequency power supply unit was again placed in a Slack Associates, Inc. Model No. 1061 evacuation heating oven and dried at 85° C. at a pressure of about 65 milliTorr. After 2.37 hours water was still being removed from the high voltage high frequency power supply unit at a rate of about 7.9 mg/minute. After another 18 hours of additional drying the moisture rate of removal reached the 1.5 milligram per minute range. After a total of about 26 hours of vacuum drying a total of about 1.75 grams of water had been removed and the rate had fallen to about 1.3 mg of water per minute.

Figure 9:
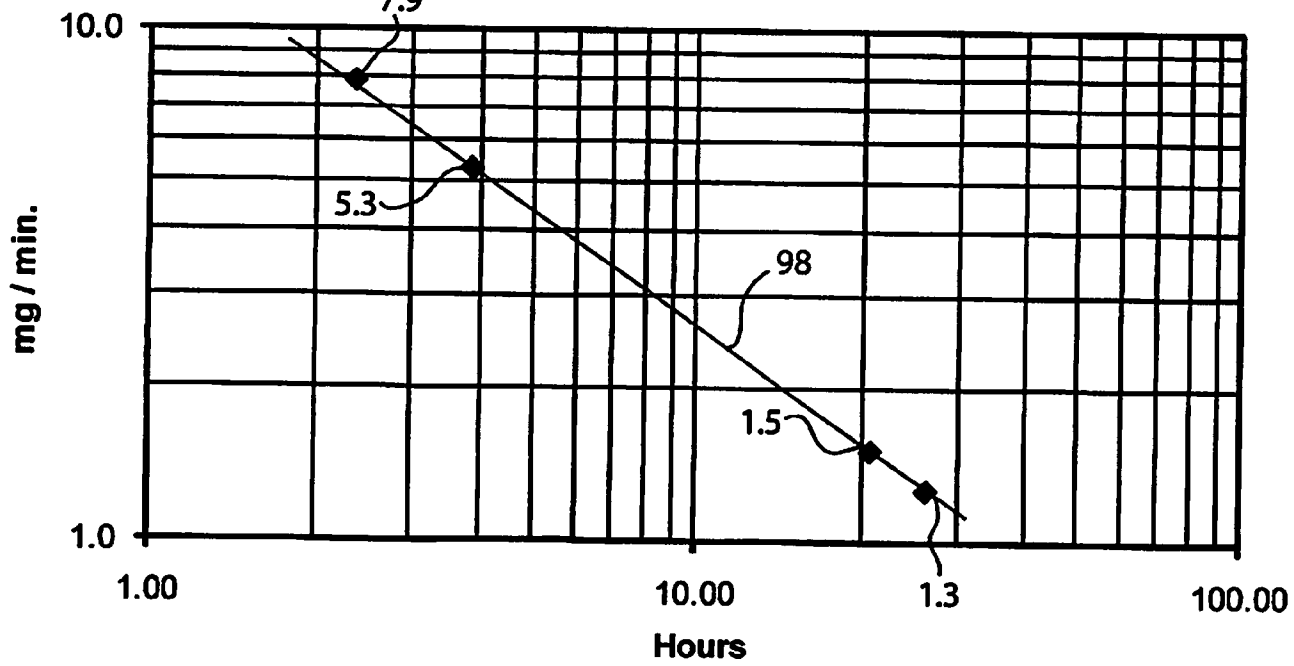
FIG. 9 is a data list and graph illustrating the rate of removal of absorbed moisture removed from the high voltage high frequency power supply of FIG. 8 after a first drying to remove embedded moisture and after about 3 days exposure to ambient atmosphere.

The data and graph illustrating the removal of moisture on a first redrying of the high voltage high frequency power supply from the FCR APG-68 tactical radar dual mode transmitter is illustrated in FIG. 9 illustrating an Average Rate Line 98 showing a rate of removal as a function of time on a log-log scale.

Example 3

The same high voltage high frequency power supply of the FCR APG-68 tactical radar dual mode transmitter from the B1 bomber of Example 2 was left exposed to ambient atmosphere for about an additional three days. The high voltage high frequency power supply was placed in a Slack Associates, Inc. of Baltimore, Md. evacuation heating oven Model No. 1061 and evacuated to a pressure of about 75 milliTorr for about 6 hours at 85° C. After about 6.12 hours of vacuum drying the rate of moisture removal had fallen to about 2.6 milligrams of water per minute and an additional 1.47 grams of moisture had been removed.

Figure 10:
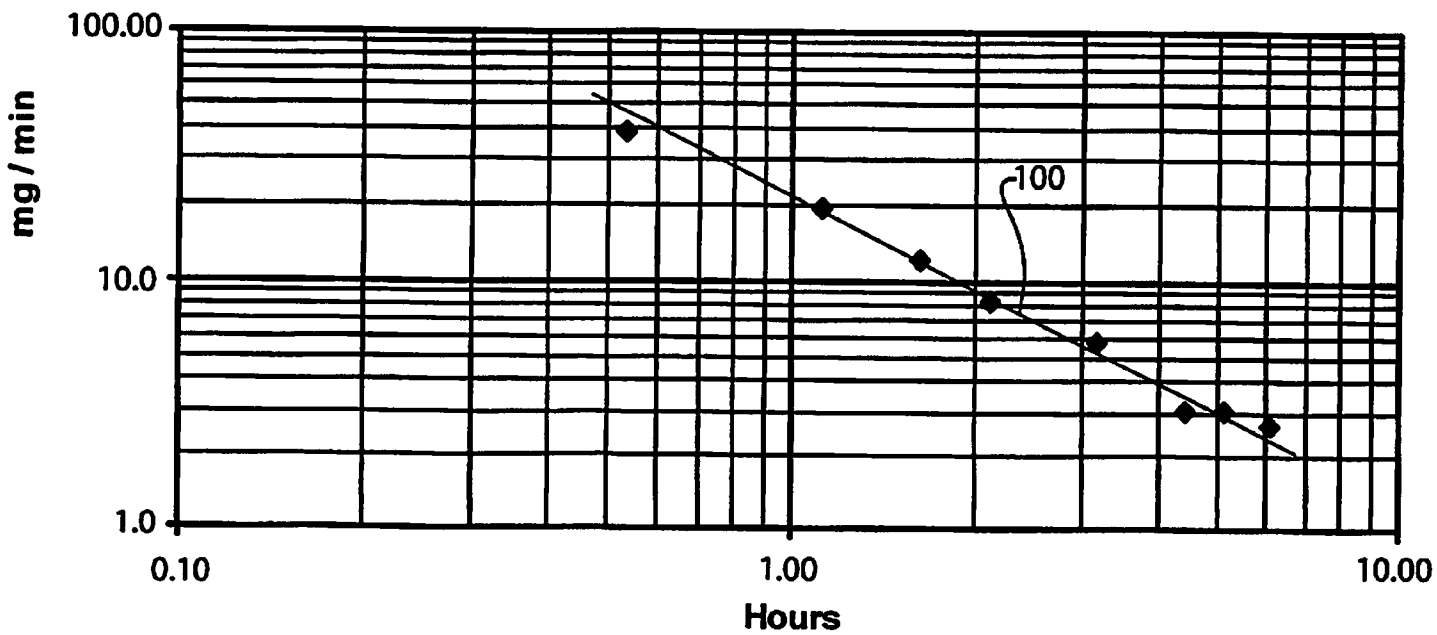
FIG. 10 is a data list and graph illustrating the rate of removal of absorbed moisture removed from the high voltage high frequency power supply of FIG. 9 after about an additional 3 days exposure to ambient atmosphere.

The data results and graph illustrating the second redrying removal of moisture from the high voltage high frequency power supply from the FCR APG-68 tactical radar dual mode transmitter is illustrated in FIG. 10 illustrating an Average Rate Line 100 showing a rate of removal as a function of time on a log-log scale.

Example 4

The same high voltage high frequency power supply of the FCR APG-68 tactical radar dual mode transmitter from the B1 bomber of Example 3 was exposed to ambient atmosphere for about 7 additional days. The twice previously redried high voltage high frequency power supply was again placed in a Slack Associates, Inc. of Baltimore, Md. evacuation heating oven Model No. 1061 and evacuated to a pressure of about 800 milliTorr and heated to about 70° C. for about an additional 48 hours before the moisture rate of removal reached about 0.4 milligrams per minute. A total of about 2.93 grams of water was removed during the total drying time of 47.72 hours.

Figure 11:
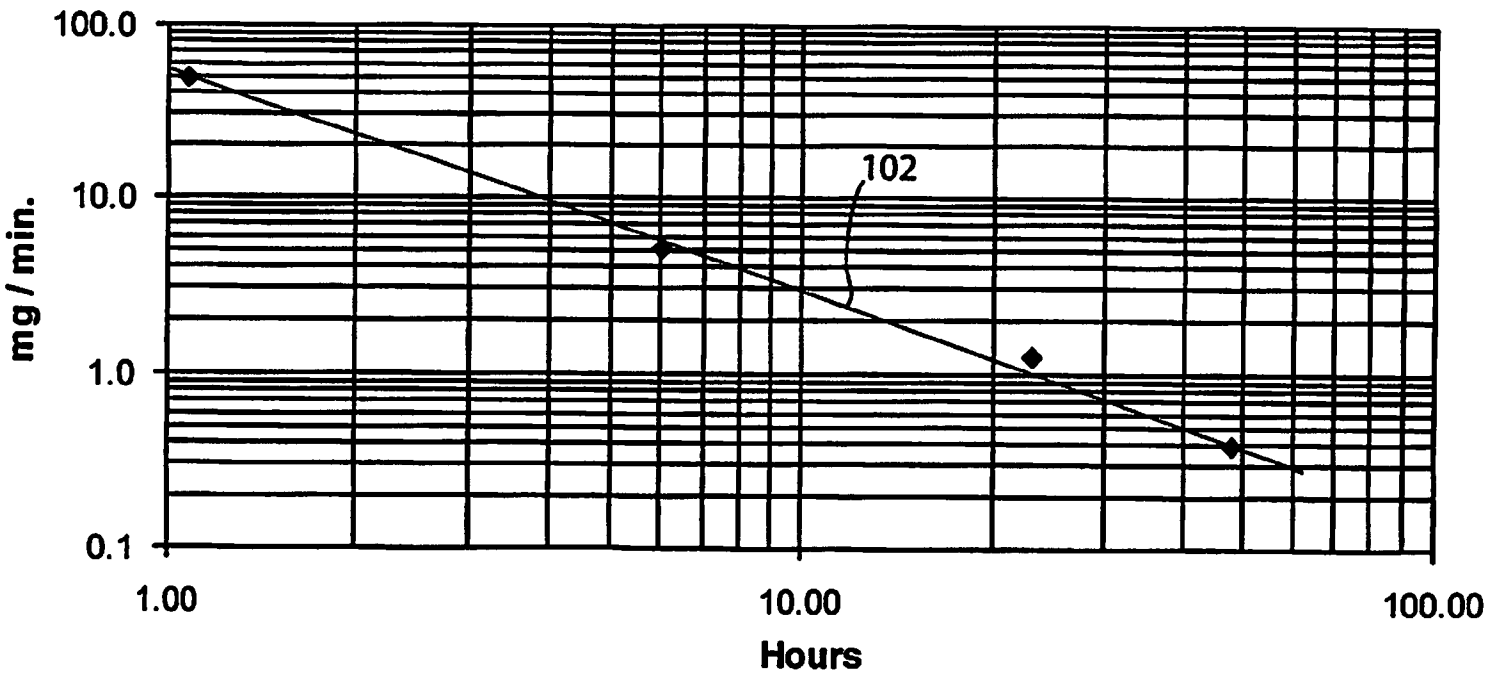
FIG. 11 is a data list and graph illustrating the rate of removal of absorbed moisture removed from the high voltage high frequency power supply of FIG. 10 after about an additional 7 days exposure to ambient atmosphere.

The data and graph illustrating the removal of moisture on the third redrying of the high voltage high frequency power supply from the FCR APG-68 tactical radar dual mode transmitter is illustrated in FIG. 11 illustrating an Average Rate Line 102 showing a rate of removal as a function of time on a log-log scale.

Example 5

The same high voltage high frequency power supply of the FCR APG-68 tactical radar dual mode transmitter from the B1 bomber of Example 4 was exposed to ambient shop atmosphere for an additional 6 days. The thrice previously redried high voltage high frequency power supply was again placed in a Slack Associates, Inc. evacuation heating oven Model No. 1061 and evacuated to a pressure of about 100 to 300 milliTorr for about an additional 48 hours at about 60° C. It took 45.97 hours for the rate of removal of moisture to drop to approximately 0.2 mg/minute. A total of about 1.3 grams of water was removed in the fourth redrying procedure.

Figure 12:
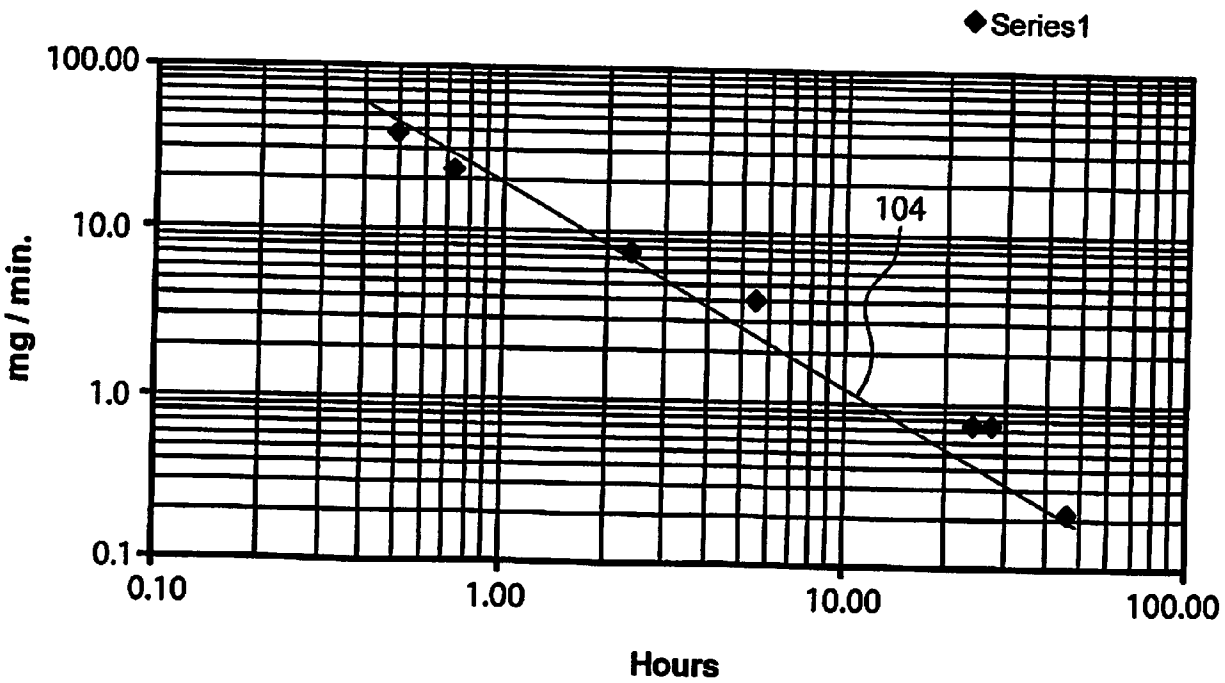
FIG. 12 is a data list and graph illustrating the rate of removal of moisture removed from the high voltage high frequency power supply of FIG. 11 after about an additional 6 days exposure to ambient temperature.

The data and graph illustrating the removal of moisture on the fourth redrying of the high voltage high frequency power supply from the FCR APG-68 tactical radar dual mode transmitter is illustrated in FIG. 12 illustrating an Average Rate Line 104 showing a rate of removal as a function of time on a log-log scale.

The method of the invention as will be recognized by those skilled in the art has a wide range of applications to remediating the premature ageing of the FCR APG-68 dual radar transmitters. The invention may be implemented for reconditioning previously repaired high voltage high frequency power supply units as well as units that have not been previously repaired by removing deleterious embedded and absorbed moisture.

Those skilled in the art will also recognize that the method of the invention provides a wide variety of variations in the use of fluid impingement and fluid flow to remove contaminants from the interior surfaces of the cold plates and heat exchangers. For example the flow may be produced by pumping fluid from a manifold directly into the ports of the cold plates or by applying a suction to such ports. When suction is employed the fluid may be a more aggressive solvent than one of the Fluorinert™ compositions, since in this case it can be prevented from contacting any of the electronic components mounted on the cold plate. There are few restrictions on what chemically compatible fluids may be used to clean the aluminum heat transfer surfaces of the heat exchangers. Those skilled in the art will also recognize that the fluid need not be homogeneous, in that it may contain dispersed air or finely divided solids to assist in the removal of contaminants.

Those skilled in the art will also recognize the method of the invention may be used and modified in different ways to suit particular requirements. For example the invention may include separate repair facilities and separate reconditioning facilities as well as separate final reassembly facilities in which case the reconditioned high voltage high frequency power supply unit should be vacuum sealed or packaged in a dry and substantially inert atmosphere.

Those skilled in the art will also recognize that an unheated drying chamber may be utilized where hot dry air is supplied to an evacuated drying chamber. It will also be recognized that the chamber is preferably a vacuum chamber to assist in the removal of embedded moisture.

Those skilled in the art will also recognize the method of the invention provides a wide variety of variations in the use of temperature, pressure and time to remove embedded moisture and absorbed moisture from high voltage high frequency power supply units to increase their useful MTBF. These and other such variations are intended to be included within the scope of the appended claims.

As used herein and in the following claims, the words "comprising" or "comprises" is used in its technical sense to mean the enumerated elements included but do not exclude additional elements which may or may not be specifically included in the dependent claims. It will be understood such additions, whether or not included in the dependent claims, are modifications that both can be made within the scope of the invention. It will be appreciated by those skilled in the art that a wide range of changes and modification can be made to the invention without departing from the spirit and scope of the invention as defined in the following claims:

TERMINOLOGY REFERENCE LIST

High Voltage High Frequency Power Supply

Cockpit 20
Military aircraft 22
Pilot 24
Control stick 26
Avionics panel 28
FCR APG-68 display screen 30
Radar antenna 32
FCR APG-68 dual mode transmitter 34
Nose 36
Buttons 38
Heads up display (HUD) 40
Sealed aluminum high voltage pressure vessel 42
Protective shrouds or cover 44
Bolt holes 45
Bolts 46
Pressure relief valve 47
Upper housing or covers 48
Valve 49
Liquid or Air cooled cold plate 50
Cap 51
Cooling hose 52
Valve actuator 53
Traveling wave tube (TWT) 54
Coolanol™25R 56
Dust or soot 57
Fins 58
Cooling air inlet 60
Inlet slots 61
Contamination 62
Apertures 63
High voltage high frequency power supply 64
Heat transfer passages 65
Inlet feed pipe 67
High voltage wiring 68
Chamber 69
Rotatable Frame 69A
Transformers 70
Multiple manifold jets 71
Heat transfer surfaces 72
Elastomeric gasket 73
Capacitors 74
Capacitors 74A
Inlet 75
High voltage resistors 76
Suction line 77
Circulating pump 78
Cooling tubes 80
Vacuum line 81
Heating oven 82
Pressure relief port 83
Fill valve port 84
Vacuum pump or source 85
Filter 86
Separator 87
Suction blower 88
Rectangular box (FIG. 7) 90
Line (FIG. 7) 92
Average rate line (FIG. 8) 96
Average rate line (FIG. 9) 98
Average rate line (FIG. 10) 100
Average rate line (FIG. 11) 102
Average rate line (FIG. 12) 104
Liquid air mixer 105
Heat exchanger 106
Cleaning solvent or solution 107
Circulation pump 108
Air inlet 109
Inlet port 110
outlet 111
Coolanol™ Passages 112
Air passages 113
Heat exchanger transfer surface 114
Air outlet 115
Cleaning solution valve 116
Cleaning solution valve 117
Cleaning solution valve 118
cleaning solution valve 119
Slots 166

What is claimed is:

1. A method of increasing the operational life of an FCR APG-68 tactical radar unit comprising:

(a) disassembling an FCR APG-68 tactical radar unit;

(b) placing a power supply chassis in an evacuation chamber;

(c) providing hot dry air to said evacuation chamber at a temperature of about 40° C. to 105° C.;

(d) operating said evacuation chamber until the rate of moisture removal is less than about 20 milligrams per minute at about 70° C. or for at least 2 hours; and (e) cleaning internal heat transfer surfaces of a cold plate and/or a heat exchanger of a power supply chassis by forcing a cleaning fluid through the cold plate and/or heat exchanger before or after the step of placing the power supply chassis in the evacuation chamber.

2. The method of claim 1 wherein the FCR APG-68 tactical radar unit is partially disassembled and the step of cleaning is achieved by pulling the cleaning fluid while a negative pressure is maintained in the evacuation chamber.

3. The method of claim 1 further comprising the step of cleaning a heat exchanger by forcing a cleaning fluid through the heat exchanger.

4. The method of claim 1 wherein the cleaning solution is forced through the cold plate at a rate of about 5 to 50 gallons per minute.

5. The method of claim 1 wherein the cleaning fluid is a mixture of a gas and a liquid and is sprayed through the cold plate.

6. The method of claim 1 wherein the cleaning fluid is a dielectric fluid.

7. The method of claim 1 wherein the step of cleaning the internal surfaces of the cold plate is accomplished before placing the power supply chassis in the evacuation chamber.

8. The method of claim 1 wherein the step of cleaning the internal surfaces of the cold plate is achieved by pumping a cleaning fluid in one end of the cold plate and evacuating the cleaning fluid from the other end of the cold plate.

9. The method of claim 3 wherein the cleaning fluid is a dielectric cleaning fluid and is forced through the heat exchanger at a rate of from about 5 to 50 gallons per minute.

10. The FCR APG-68 tactical radar unit produced by the process of claim 1.

11. In a process for improving a tactical radar unit wherein the improvement comprises the step of cleaning heat transfer surfaces of a cold plate or a heat exchanger by forcing a cleaning fluid through a cold plate or a heat exchanger before or after a step of removing moisture from a high voltage high frequency power supply by placing a high voltage high frequency power supply in a vacuum chamber having a heated environment until at least 3 grams of water are removed, or condensing moisture until at least 3 grams of water are removed through a cold trap disposed between said vacuum chamber and a vacuum pump.

12. The process of claim 11 wherein the step of cleaning the heat transfer surfaces is achieved by forcing the cleaning fluid through the cold plate or a heat exchanger by utilizing a negative pressure.

13. The process of claim 11 wherein the cleaning fluid is forced through the cold plate or the heat exchanger at a rate of about 5 to 50 gallons per minute.

14. The process of claim 13 wherein the cleaning fluid is forced through the cold plate or the heat exchanger at a rate of about 25 gallons per minute.

15. The process of claim 11 wherein the cleaning fluid is a dielectric fluid.

16. The process of claim 11 wherein the cleaning fluid is a bath of dielectric fluid.

17. The process of claim 11 wherein the cleaning fluid is a mixture of an air and a liquid.

18. The process of claim 17 wherein the cleaning fluid is pumped into one end of the cold plate or heat exchanger and is evacuated from the other end of the cold plate or heat exchanger.

19. The process of claim 18 wherein the cleaning fluid is withdrawn by a suction blower providing a negative pressure of about 5 to 90 inches of water.

20. The process of claim 11 wherein the cleaning fluid is an aqueous based cleaning fluid.

21. The tactical radar unit produced by the process of claim 11.

22. A method for cleaning and removing moisture from a FCR APG-68 tactical radar unit comprising the steps of:

(a) cleaning the internal heat transfer surfaces of a cold plate or a heat exchanger by forcing a cleaning fluid through the cold plate or the heat exchanger utilizing a positive or negative pressure;

(b) opening a fill valve port and a pressure relief valve port in a tactical radar unit;

(c) placing the tactical radar unit in a heating oven;

(d) providing a vacuum source capable of providing a vacuum of about 10 Torr or below; and (e) heating the heating oven in the range of about 40° to 105° C.

23. The method of claim 22 wherein the step of cleaning the internal surfaces of the cold plate or the heat exchanger is accomplished before opening the fill valve port.

24. The FCR APG-68 tactical radar unit produced by the process of claim 22.

* * * * *